United States Patent [19]

Stahlecker

[11] Patent Number: 4,757,678

[45] Date of Patent: Jul. 19, 1988

[54] OPEN-END ROTOR SPINNING MACHINE

[75] Inventor: Fritz Stahlecker, Josef-Neidhart-Strasse 18, 7347 Bad Überkingen, Fed. Rep. of Germany

[73] Assignees: Hans Stahlecker; Fritz Stahlecker, both of Fed. Rep. of Germany

[21] Appl. No.: 117,054

[22] Filed: Nov. 5, 1987

[30] Foreign Application Priority Data

Nov. 25, 1986 [DE] Fed. Rep. of Germany ..... 3640217

[51] Int. Cl.[4] ..... D01H 15/02; D01H 7/885

[52] U.S. Cl. ..... 57/263; 57/301; 57/302; 57/304; 57/405; 57/417

[58] Field of Search ..... 57/261–263, 57/301, 302, 304, 305, 404, 405, 414–417

[56] References Cited

U.S. PATENT DOCUMENTS

| | | | |
|---|---|---|---|
| 3,425,205 | 2/1969 | Landwehrkamp et al. | 57/417 X |
| 3,789,597 | 2/1974 | Schon | 57/417 |
| 3,861,131 | 1/1975 | LeChatelier | 57/417 |
| 3,962,855 | 6/1976 | Stahlecker | 57/263 |
| 3,999,362 | 12/1976 | Schulz et al. | 57/263 |
| 4,114,356 | 9/1978 | Eckhardt | 57/263 |
| 4,481,766 | 11/1984 | Kurushima et al. | 57/417 |
| 4,499,719 | 2/1985 | Faessler | 57/417 |
| 4,635,436 | 1/1987 | Malina et al. | 57/417 |
| 4,665,687 | 5/1987 | Ott et al. | 57/417 |

FOREIGN PATENT DOCUMENTS

| | | |
|---|---|---|
| 2366255 | 3/1983 | Fed. Rep. of Germany . |
| 2532665 | 3/1984 | France . |

*Primary Examiner*—John Petrakes

*Attorney, Agent, or Firm*—Barnes & Thornburg

[57] ABSTRACT

An open-end rotor spinning apparatus is provided which includes at least one spinning unit having yarn deflecting elements downstream from a yarn withdrawal duct. The yarn deflecting elements deflect yarn from the yarn withdrawal duct in a yarn spinning path. The yarn deflecting elements include at least one false-twisting edge. Yarn returning elements are provided for returning a yarn end to the yarn withdrawal duct past the yarn deflecting elements in a piecing path having a deflection less than the yarn spinning path deflection.

36 Claims, 22 Drawing Sheets

Fig. 5
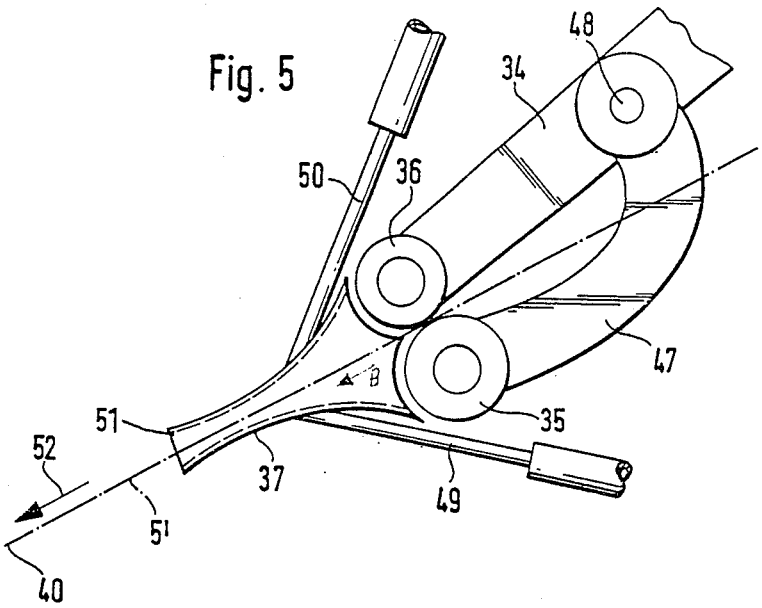
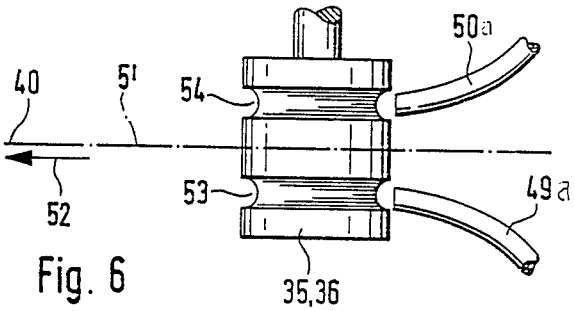
Fig. 6

2
5
91
39
33
32
XXIII
92
93
31
112
109
113
29
27
26
25
19
23
22
21
13
24
20
15
18
16
17
14

2
5'
13
14
15
16
17
18
19
20
21
22
23
24
25
26
27d
28
29
31
32
33
34
35
36
37
40
146
147

OPEN-END ROTOR SPINNING MACHINE

BACKGROUND AND SUMMARY OF THE INVENTION

The invention relates to open-end rotor spinning machines, having a plurality of spinning units that each contain a spinning rotor that is arranged in a rotor housing connected to a vacuum source. The spinning units include at least one yarn-deflecting point that is formed by at least one false-twisting edge being assigned to this yarn withdrawal duct, and a movable servicing apparatus that can be applied to the individual spinning units which is equipped with devices for the feeding of a yarn end to the yarn withdrawal duct.

In German Patent No. 23 66 255, an open-end rotor spinning machine of the initially mentioned type is shown in which the yarn withdrawal duct consists of a yarn withdrawal nozzle to which a one-piece tube is connected that has a bend. For the piecing, a yarn end is applied to this yarn withdrawal tube which is then sucked into the yarn withdrawal duct because of the vacuum existing in the spinning rotor, and is subsequently applied to the spinning rotor.

French Patent No. 25 32 665 shows replacing the deflecting point of the yarn withdrawal duct by an insert that forms at least one false-twisting edge. By means of these types of false-twisting edges, the twist of the spun yarn can be reduced and/or the danger of yarn breakages can be diminished. The false-twisting edges that project into the moving path of the yarn, however, impair the returning of the yarn end for a piecing. In addition, in the area of the false-twisting edges, a rubbing-off of the yarn is created, in which case the rubbed-off parts may deposit in this area. As a result, the returning of the yarn end during the piecing is impaired, and the danger is created that these rubbed-off parts are sucked back into the spinning rotor and cause disturbances, particularly during the piecing. It is therefore necessary that a yarn withdrawal tube of this type be cleaned before a piecing, in which case, however, the area of the false-twisting edges is not easily accessible for a cleaning.

An object of the invention is to provide an open-end rotor spinning machine in which the use of false-twisting edges does not result in an impairment of the returning of a yarn end.

Another object of the invention is to provide an open-end rotor spinning machine having false-twisting edges in which costly cleaning operations are not required. Yet another object of the invention is to provide false-twisting edges which are easily accessible, and therefore easily cleaned.

Still a further object of the invention is to provide false-twisting edges being disposed such that any impurities created at the false-twisting edges are less apt to accumulate and impair spinning or piecing processes.

These objects are achieved by providing an open-end spinning machine having a deflecting component having at least one false-twisting edge downstream from a yarn withdrawal duct. A yarn returning element returns a yarn end to the yarn withdrawal duct past the deflecting component in a piecing operation such that the yarn is deflected less during piecing than during spinning.

Using this arrangement, it is possible to arrange the deflecting component having the false-twisting edges in the open so that rubbed-off yarn parts that occur in this area do not remain in the area of the false-twisting edges. In certain preferred embodiments, a yarn end bypasses the component containing the false-twisting edges during a piecing as the yarn is fed to the mouth of the straight yarn withdrawal duct, such that there is no danger that the returning yarn end can become caught in the area of the false-twisting edges. In addition, the advantage is obtained that the component containing the false-twisting edges can be held independently of the yarn withdrawal duct so that, if required, it alone can be replaced.

According to other advantageous features of certain preferred embodiments of the invention, in order to facilitate the returning of the yarn end, a guiding element is provided that extends to a covering that covers the spinning units toward the outside. The guiding element is arranged behind the deflecting component containing the at least one false-twisting edge. This guiding element is used for aligning the yarn end with the mouth of the short, straight yarn withdrawal duct. In certain embodiments, the distance between the guiding element and the mouth of the yarn withdrawal duct can be bridged with sealing devices that form a connecting duct. Particularly, when the guiding element is developed as a tube that has the dimensions of a conventional yarn withdrawal tube, it is possible to create the same conditions as in the case of previous yarn withdrawal tubes for the sucking-back of a yarn end required for the piecing.

According to other advantageous features of certain preferred embodiments of the invention, it is provided that the deflecting component is held so that it can be adjusted between an operating spinning position and a piecing position. In these embodiments, the at least one false-twisting edge is located on the outside of an extension of the yarn withdrawal duct in the piecing position. As a result, it is ensured that the returning of a yarn end is not impaired by the false-twisting edges. In a particularly advantageous contemplated embodiment, it is further provided that connecting devices for connecting the yarn withdrawal duct with the guiding element are provided. When the deflecting component is located in the piecing position, the connecting devices can be introduced between the mouth of the yarn withdrawal duct and the guiding element, replacing the deflecting component, and establishing an approximately airtight connection between the guiding element and the yarn withdrawal duct.

In certain preferred embodiments, these connecting devices may be divided by a dividing seam extending in longitudinal direction of the yarn, so that after the piecing, they are moved out from between the area of the mouth of the yarn withdrawal duct and the guiding element. The false-twisting edges are then brought into the operating position. In this operating position, the area below the false-twisting edges will then be in the open so that rubbed-off yarn parts cannot deposit in the area of the yarn movement. In these embodiments, it is possible to create the same conditions for the piecing that normally exist in spinning units with closed yarn withdrawal tubes having a uniform cross-section. It is contemplated that the connecting devices for connecting the yarn withdrawal duct with the guiding element are a component of each spinning unit and are adjusted by the servicing device during the piecing. However, it is also contemplated to make these devices components of the servicing device so only one is required for one open-end spinning machine.

According to other advantageous features of certain preferred embodiments of the invention, it is provided that each spinning unit is equipped with air blowing devices for generating an air current that is aimed essentially in the direction of the mouth of the yarn withdrawal duct. The air blowing devices can be switched on and off by the movable servicing device. As a result, each spinning unit is equipped with pneumatic auxiliary transport devices by means of which the transport of yarn can be promoted from the feeding devices of the servicing device to the mouth of the yarn withdrawal duct.

According to other advantageous features of certain preferred embodiments of the invention, it is provided that the movable servicing device is equipped with devices for generating a blowing air current aimed at the mouth of the yarn withdrawal duct. In these embodiments, any other guiding elements or the like that guide the yarn behind the deflecting component are not necessary.

Since the deflecting component having the false-twisting edges may be arranged in the open, it is provided in certain preferred embodiments of the invention that collecting devices are arranged below the deflecting component in the open at least during the normal spinning operation. The collecting devices are used for the catching and/or removing of material that is detached from the yarn. These embodiments prevent contamination of the spinning units by rubbed-off pieces of yarn.

Other objects, advantages and novel features of the present invention will become apparent from the following detailed description of the invention when taken in conjunction with the accompanying drawings.

BRIEF DESCRIPTION OF THE DRAWINGS

FIG. 5 is a schematic view of a feeding device of a servicing arrangement according to certain preferred embodiments of the invention;

FIG. 6 is a schematic view of another embodiment of a feeding device;

DETAILED DESCRIPTION OF THE DRAWINGS

Figure 1:
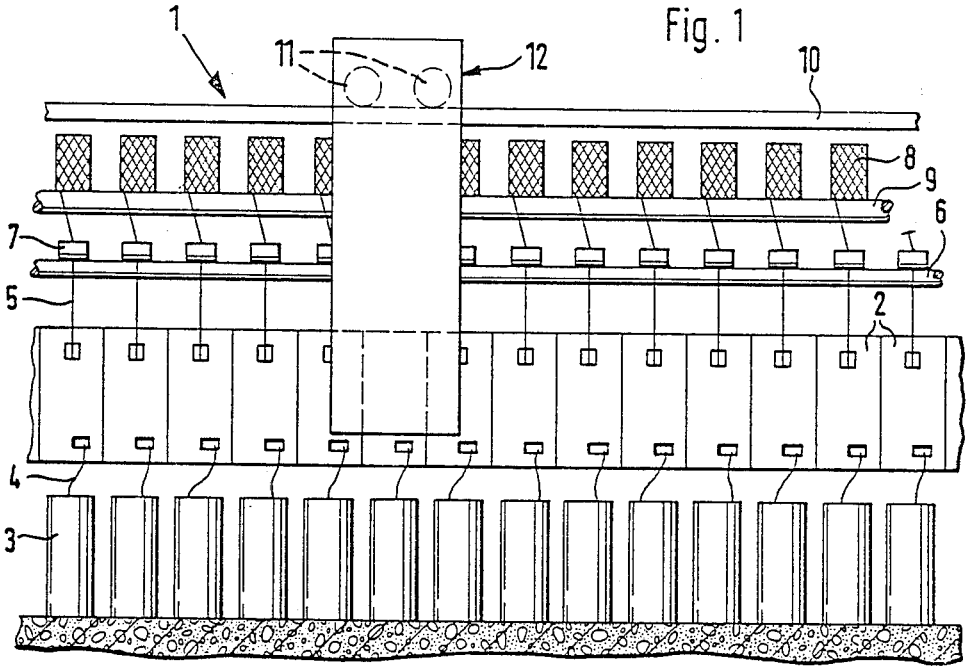
FIG. 1 is a schematic view of a part of an open-end rotor spinning machine having a movable servicing device.

FIG. 1 shows a portion of an open-end rotor spinning machine 1 that is equipped with a plurality of spinning units 2 that are arranged in a row next to one another. Normally, spinning units 2 of this type are located on the two longitudinal sides of the open-end rotor spinning machine 1. To each spinning unit 2, a sliver can 3 is assigned from which a sliver 4 to be spun is taken that in the spinning units 2 is spun into a yarn 5. This yarn 5 is in each case withdrawn from the spinning unit by a withdrawal device that includes a driven bottom roller 6 moving through in longitudinal direction of the machine as well as of one respective pressure roller 7. The spun yarn 5 in each case is wound onto a windup spool 8 that is driven by a winding roller 9 moving through in longitudinal direction of the machine.

The open-end rotor spinning machine 1 is equipped with rails 10 on which a servicing device 12 moves that is equipped with an undercarriage 11 containing a drive. In the case of a yarn breakage, the servicing device 12 is applied to the respective spinning unit 2, after which the servicing device 12 carries out a piecing operation there. In principle, piecing operations are known on the basis of the state of the art so that these operations do not have to be explained in detail.

Figure 2:
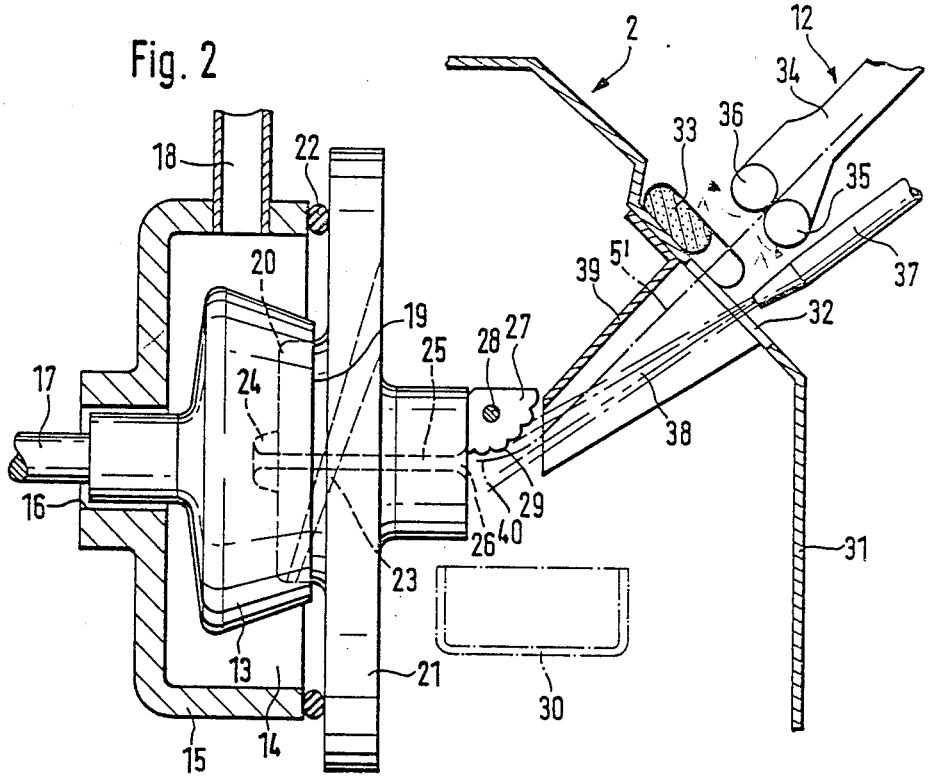
FIG. 2 is an enlarged partial cross-sectional view of a spinning unit of an open-end rotor spinning machine according to certain preferred embodiments of the invention.

As shown in FIG. 2, each spinning unit 2 contains a spinning rotor 13 that is arranged in a vacuum chamber 14 that is formed by a rotor housing 15. A rear wall of the rotor housing 15 has a bore 16 through which a shaft 17 of the spinning rotor 13 is guided, that is disposed and driven outside the rotor housing 15 in a way that is not shown in detail. At the rotor housing 15, a suction line 18 is connected via which a vacuum is created on the inside of the spinning rotor 13. A lid 21 closes the open side of the rotor housing 15 and of the rotor 13. The lid 21 includes an insert 20 that projects into the open front side 19 of the spinning rotor 13, and is located such that its axis is horizontal. With the insertion of a sealing ring 22, the lid 21 rests against the rotor housing 15. The lid 21 contains a fiber feeding duct 23, via which the fiber material, that in a known way has already been separated into individual fibers, is fed to the spinning rotor 13.

In the spinning rotor 13, the fibers are twisted together into a yarn 5 that is withdrawn via a yarn withdrawal nozzle 24 that is arranged centrally with respect to the spinning rotor 13, and via a connecting yarn withdrawal duct 25 that extends coaxially with respect to the shaft 17 of the spinning rotor 13. The yarn withdrawal duct 25 extends in a straight line and is usually kept very short, for example in an extreme case, includes practically only the bore of the yarn withdrawal nozzle 24. The yarn withdrawal duct 25 is followed by a deflecting component 27 which includes rib-type false-twisting edges 29 which project into the moving path of the yarn. In certain preferred embodiments, the component 27 is made of a ceramic material and has at least one false-twisting edge 29 having an approximately semicircular or quarter-circular cross-section and is sloped by 45° with respect to the moving direction of the yarn in such a way that it extends approximately in parallel to the twist of the spun yarn 5. In the area of the false-twisting edges 29 of the component 27, the yarn 5 is deflected in upward direction.

Each spinning unit 2 is provided with a covering 31 that can be moved away preferably by swivelling and is equipped with a window-type recess 32 where the yarn 5 is led out. In the area of this window-type recess 32, a yarn guide 33 is arranged that can also be made of a ceramic material and at which another deflection of the spun yarn 5 takes place in upward direction toward a withdrawal device.

As shown in FIG. 2, component 27 with the false-twisting edges 29 is located completely outside the yarn withdrawal duct 25, so that rubbed-off yarn pieces occurring at the false-twisting edges 29 can fall down and do not remain in the area of the yarn withdrawal duct 25. Advantageously, a yarn collecting device 30 is provided below component 27 to collect any impurities, which may include a box that can be taken out in the manner of a drawer, or a transport device or a suction device that is covered from the outside by the covering 31. Component 27 is held by a pin 28, such as a headless pin, at a projection of the lid 21 that is not visible in FIG. 2 so that after the opening of the covering 31, the component 27 is also easily accessible and can be exchanged easily.

During a piecing after a yarn breakage or also in the case of a first-time start spinning, one end 40 of a yarn 5' to be returned must be returned into the spinning rotor 13, must be connected with fibers at the spinning rotor 13, and must be withdrawn again. For this returning, the yarn end 40 must be threaded into the mouth 26 of the yarn withdrawal tube 25 that faces away from the spinning rotor 13. The returning of the yarn 5' and the threading of the yarn end 40 into the yarn withdrawal tube 25 is monitored by the servicing device 12, of which only the devices 34 for the returning of the yarn 5' are shown. The devices 34 include a pair of clamping rollers 35, 36 that can be driven at least in return delivery direction of the yarn 5' (shown by arrows A). In addition, a blowing nozzle 37 is assigned to this pair of clamping rollers 35, 36, by means of which a conveying air current 38 can be generated that is directed from the pair of clamping rollers 35, 36 to the mouth 26 of the yarn withdrawal duct 25. In addition, in order to provide the yarn 5' to be returned with a certain guidance, a groove-shaped guiding element 39 is mounted at the covering 31 and extends from the window-type recess 32 close to or to the component 27.

As shown in FIG. 2, the end 40 of the yarn 5' to be returned is moved into the proximity of the mouth 26 of the yarn withdrawal duct 25 by means of the air current 38. The yarn withdrawal duct 25 then takes over the yarn end 40, because of the suction air flow aimed into the yarn withdrawal duct 25 which sucks the yarn end 40 in further. By means of the blowing air flow 38, it is possible to guide the yarn end 40 past the false-twisting edges 29 of the component 27.

Figure 3:
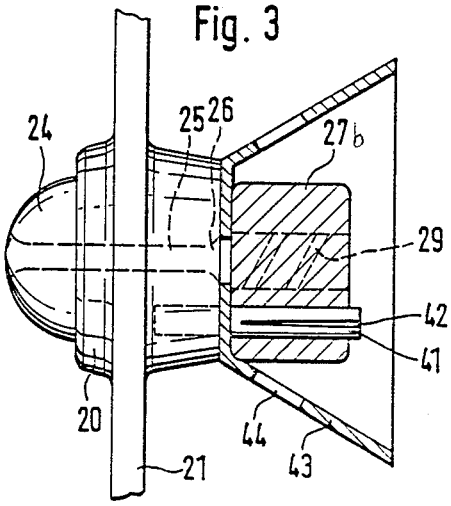
FIG. 3 is an enlarged partial cross-sectional view of a spinning unit in the area of a yarn withdrawal duct according to other preferred embodiments of the invention.

In the embodiment according to FIG. 2, the component 27 is arranged on a pin 28 that extends essentially transversely to the yarn withdrawal duct 25. FIG. 3 shows an embodiment in which the component 27*b*, having the false-twisting edges 29 that extend diagonally with respect to the moving direction of the yarn, is held with an elastic pin 41 that extends in parallel to the yarn withdrawal duct 25. The pin 41 is disposed firmly in the outer area of the lid 21, and is provided with a longitudinal slot 42 to provide flexibility in its radial direction. The component **27*b* is fitted onto the part of the pin 41 having the slot 42. Between the component 27*b* and the lid 21, a guiding funnel 43 is also arranged, which surrounds the component 27*b*. The guiding funnel 43 is provided with lateral breakthroughs 44 through which the blowing air current 38** (shown in FIG. 2) can flow off.

Figure 4:
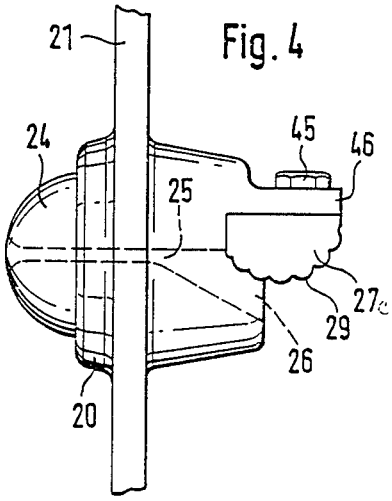
FIG. 4 is an enlarged view of another embodiment of the yarn withdrawal duct area of a spinning unit.

In FIG. 4, an embodiment of a lid 21 is shown that is provided with a projection 46, projecting on the side facing away from the yarn withdrawal nozzle 24. At this projection 46, the component **27*c* is fastened by at least one screw 45. As also shown in FIG. 4, the mouth 26 of the yarn withdrawal duct 25 is expanded so that the threading-in of a yarn end 40** to be returned is facilitated.

The devices 34 for returning a yarn 5' shown in FIG. 5 contain a pair of clamping rollers 35, 36, of which at least one is provided with a drive that acts at least in return-delivery direction (as shown by arrow B). One clamping roller 35 is held on a lever 47 that can be swivelled around a shaft 48 of an arm carrying the other clamping roller 36, so that the two clamping rollers 35, 36 can be opened by moving apart. Behind the two clamping rollers 35, 36, in yarn return direction B, an injection nozzle 37 is connected that has one end directly at the clamping gap of the clamping rollers 35, 36. The injection nozzle 37 also includes two parts with a dividing seam that is located preferably in the plane running through the clamping gap of the clamping rollers 35, 36. The injection nozzle 37 is equipped with two compressed-air feeding connections 49, 50. The mouth area of injection nozzle 37, downstream from the connections 49, 50 in yarn return direction B, includes a Laval-nozzle-shaped expansion 51, so that a well-aimed blowing air current 52 is generated, by which the yarn end 40 can be applied to the mouth 26 of the yarn withdrawal duct 25 in a very accurate way.

In the embodiment according to FIG. 6, a pair of clamping rollers 35, 36 is also combined with devices for generating a blowing air current 52. For this purpose, the two clamping rollers 35, 36 are provided with ring grooves 53, 54 in an area on each side of the area guiding the yarn 5' to be returned. Compressed-air feeding devices **49*a*, 50*a* are assigned to these ring grooves 53, 54, so that a blowing air current 52 is generated by the ring grooves 53, 54, that is aimed essentially tangentially to the clamping rollers 35, 36**.

Figure 7:
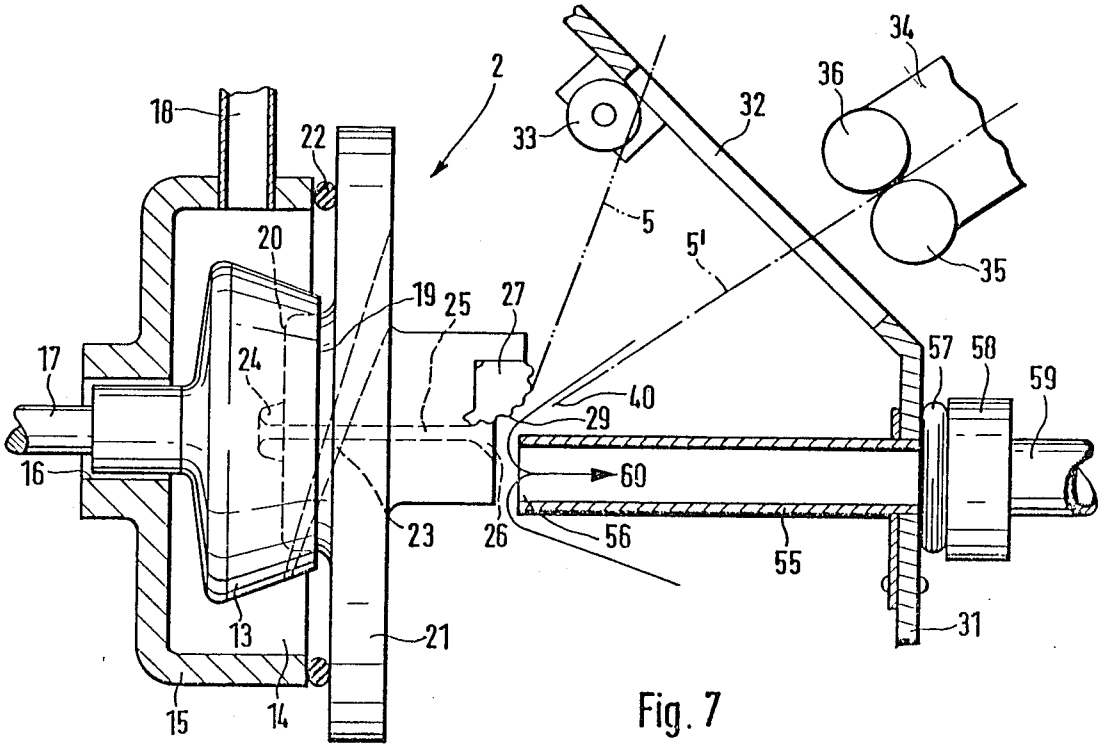
FIG. 7 is a partial cross-sectional view of a spinning unit having a device for generating a suction air current aimed essentially in the direction of the yarn withdrawal duct.

In the embodiment according to FIG. 7, a conveying air current is also generated in order to securely guide the yarn end 40 of a yarn 5' to be returned, from a pair of clamping rollers 35, 36 of the device for returning the yarn 5' to the area of the mouth 26 of a yarn withdrawal duct 25. However, this conveying air current is generated by means of a vacuum. For this purpose, a respective suction tube 55 is mounted at the covering 31 of the spinning units 2. This suction tube 55 is provided with a preferably elastic connecting ring 57 on the outside of the covering 31. A connection 58 of a suction tube 59 of the movable servicing device 12 can be applied to the connecting ring 57. The opposite end 56 of the suction tube 55 leads into the area of the mouth 26 of the yarn withdrawal duct 25 below the component 27 with the false-twisting edges 29.

Thus, a suction air flow 60 is generated that acts back on the area of the window-type recess 32 and sucks in the yarn 5' to be returned. After the yarn 5' to be returned has reached the area of the end 56 of the suction tube 55, and has possibly also been slightly sucked into the suction tube 55, the suction air flow is switched off. The suction air flow that acts in the area of the mouth 26 of the yarn withdrawal duct 25 and that is aimed into the spinning rotor 13, will then take over the yarn end 40 and suck the yarn end 40 into the yarn withdrawal duct 25.

As shown by FIG. 7, the window-type recess 32 in the covering 31 is made relatively large so that the guiding-back of the yarn 5' to be returned deviates from the normal moving direction of the spun yarn 5. In this way, the component 27 with the false-twisting edges 29 is bypassed by the returning yarn 5', to facilitate the return of the yarn 5' to the mouth 26 of the yarn withdrawal duct 25. As also shown in FIG. 7, the yarn guide 33 that is arranged in the area of the window-type recess 32 is made as a freely rotatable pulley.

Figure 8:
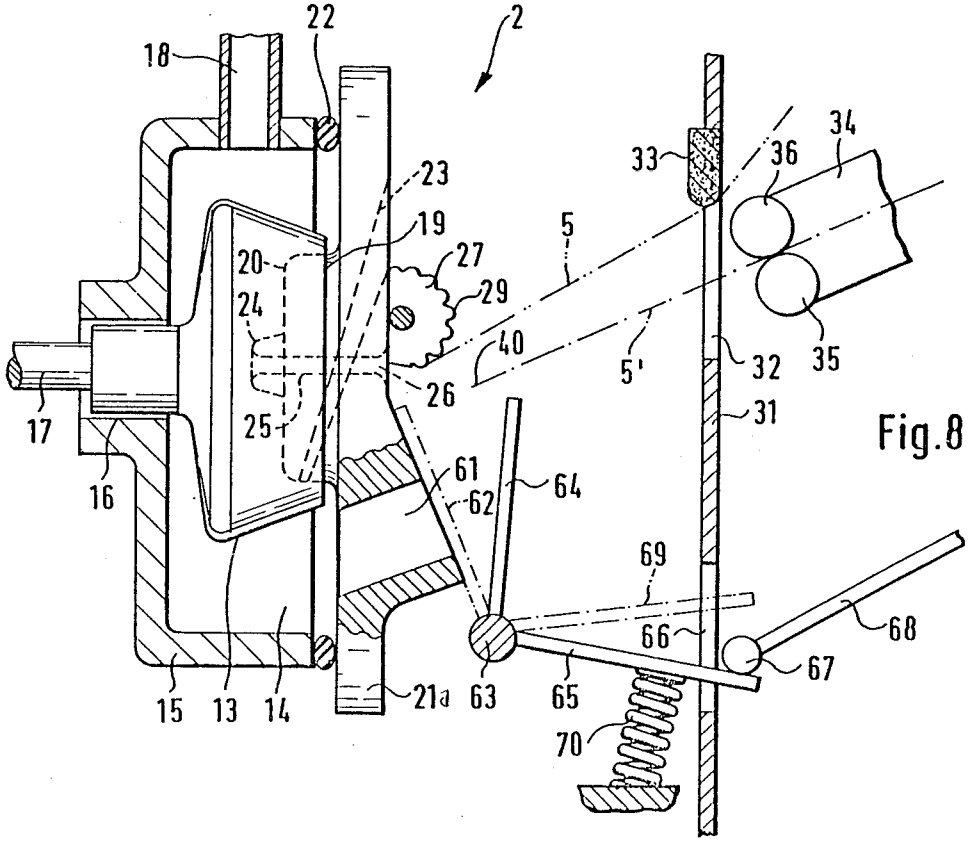
FIG. 8 is a partial cross-sectional view of another embodiment in which a suction air current is directed to the mouth of the yarn withdrawal duct by a vacuum line installed in the open-end rotor spinning machine.

Also in the embodiment according to FIG. 8, an additional suction air flow is generated which aids in guiding the yarn 5' to be returned from the devices 34 for returning the yarn 5' located outside the covering 31, toward the mouth 26 of the yarn withdrawal duct 25. For this purpose, a suction opening 61 is provided in a lid **21*a*, which can establish a connection to the vacuum chamber 14 of the rotor housing 15. The suction opening 61 is aimed at the window-type recess 32, and is located in the direct neighborhood of the mouth 26 of the yarn withdrawal duct 25**.

In the normal spinning operation, the suction opening 61 is closed by a flap 62. This flap 62 can be swivelled around a shaft 63. The flap 62 further includes a fixedly attached lever arm 69 which projects through a recess 66 of the covering 31. By means of an adjusting lever 68 that has a thrust piece 67, the lever arm 69 can be swivelled into the position 65 shown by solid lines, such that the flap 62 also swivels away from the suction opening 61 into the position shown by solid lines 64. This swivelling takes place against the effect of a pressure spring 70. When the flap is opened (position 64), a suction air flow is generated that is directed to the window-type recess 32, and by means of which the yarn 5' to be returned is sucked in. When a sufficient length of yarn 5' has been returned, the flap 62 is closed. When the flap 62 is closed, the end of the flap 62 deflects the yarn end 40 in the direction of the mouth 26 of the yarn withdrawal duct 25, so that the yarn end 40 will then be sucked in by the yarn withdrawal duct 25.

Figure 9:
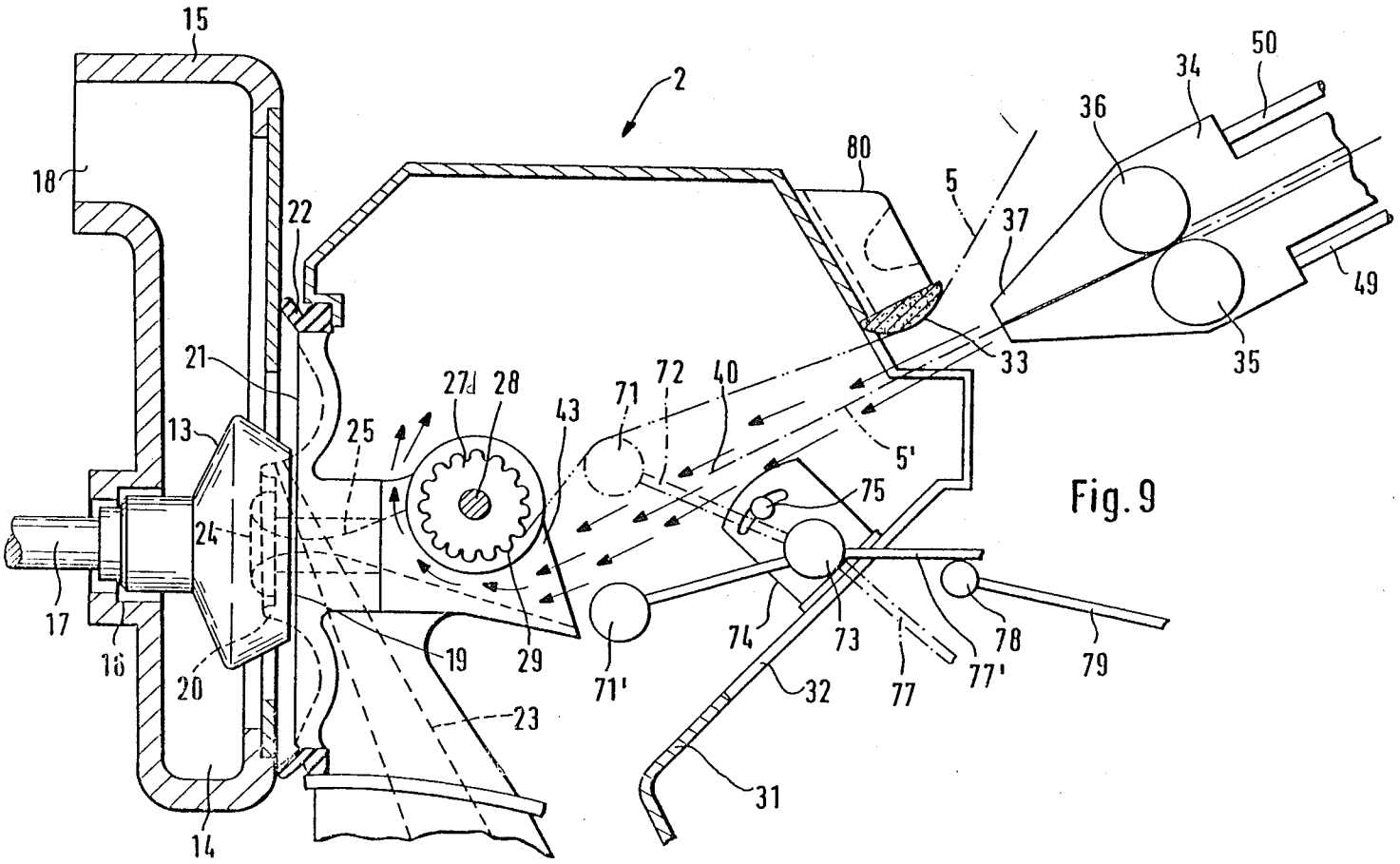
FIG. 9 is a partial cross-sectional view of a spinning unit including an additional deflecting guide.

In the embodiment according to FIG. 9, a deflecting bolt 71 is arranged between the component **27*d* having the false-twisting edges 29 and a yarn guide 33 mounted at the covering 31. This deflecting bolt 71 enlarges the winding-around deflection angle with which the yarn 5 rests against the false-twisting edges 29 of the component 27*d*. If necessary, the bolt 71 is also provided with false-twisting edges, and is arranged on a lever 72 that can be swivelled around a stationary shaft 73 that is fastened at the covering 31. The operating position of the bolt 71 is secured by a stop 75 that is adjustably mounted at a holding device 74. The lever 72 is pressed against the stop 75 by a spring that is not shown. At the shaft 73 of the lever 72, a lever arm 77 is mounted that can be swivelled out of the covering 31. An adjusting lever 79 and a thrust piece 78 can swivel the lever arm 77 into the piecing position 77' shown by solid lines. The lever arm 77 thereby moves the bolt into piecing position 71'** shown by solid lines.

In the piecing position, a yarn 5' is returned into the area of the yarn withdrawal duct 25, while bypassing component 27*d*. Component 27*d* is equipped with a guiding funnel 43 that extends past the yarn withdrawal duct 25. The devices 34 for the returning of the yarn 5' include a pair of clamping rollers 35, 36 that can be driven in return direction, and an injection nozzle 37 that generates an air current indicated by arrows in the direction of the guiding funnel 43. When the yarn end 40 of the yarn 5' to be returned has arrived in the area of the yarn withdrawal duct 25, the injection nozzle 37 is switched off. For a further return delivery of the yarn 5' by the clamping rollers 35, 36, the yarn end 40 is sucked into the yarn withdrawal duct 25. After a piecing, the bolt 71 is then returned to its operating position 71 shown by dash-dotted lines, so that the route of the yarn is restored that is used for the spinning operation.

Figure 11:
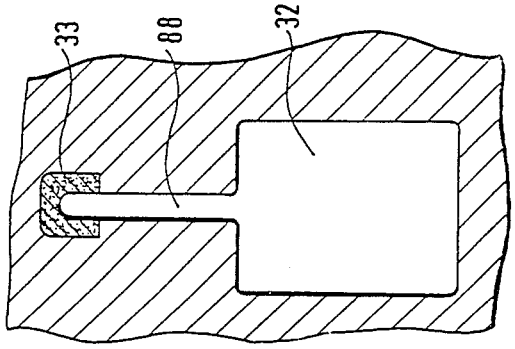
FIG. 11 is a partial cross-sectional view taken at lines XI—XI in FIG. 10.
Figure 10:
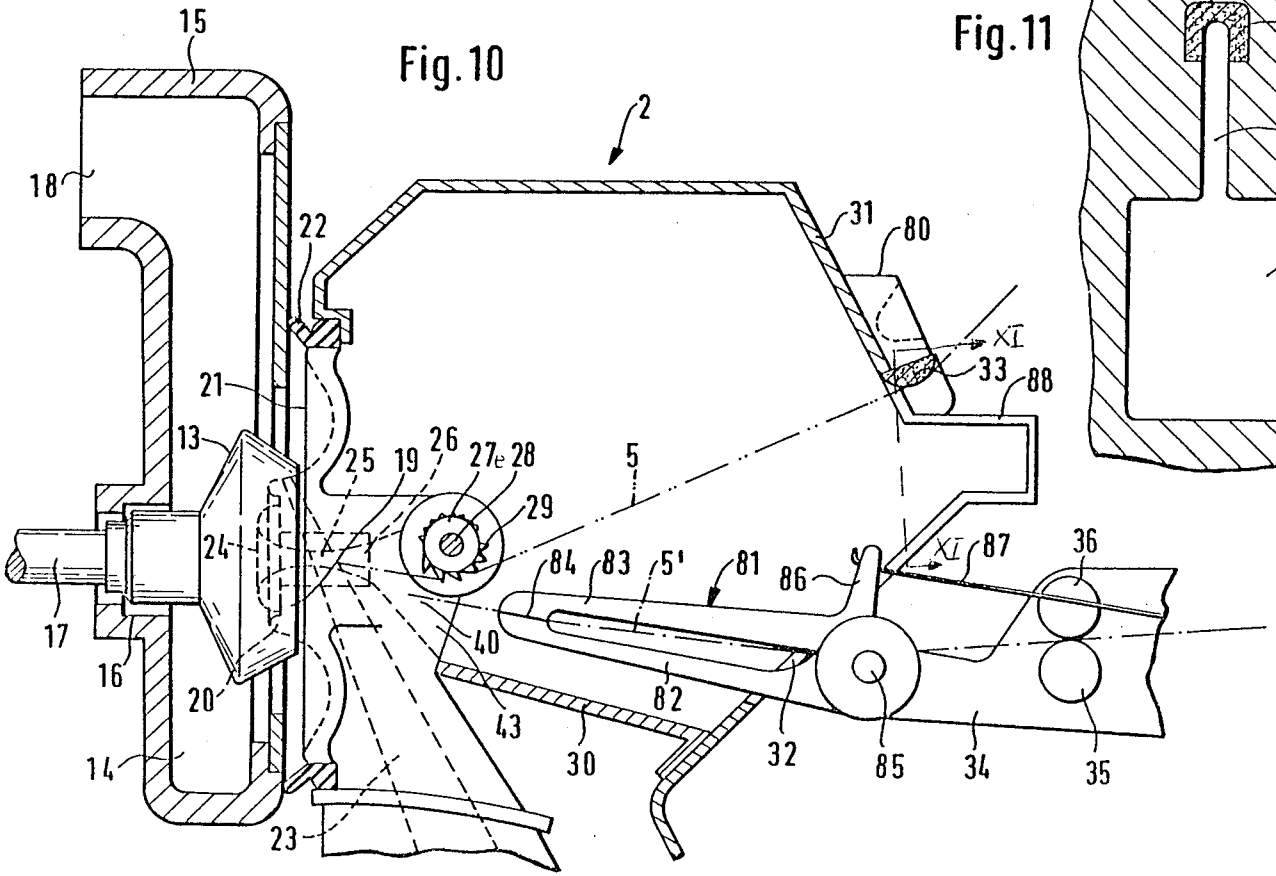
FIG. 10 is a partial cross-sectional lateral view of another embodiment of a spinning unit and of a feeding device of a servicing apparatus.

In the embodiment according to FIGS. 10 and 11, the yarn end 40 of the yarn 5' to be returned is brought into the area of the mouth 26 of the yarn withdrawal duct 25 purely mechanically without any additional air current. The devices 34 for the returning of the yarn 5' are equipped with a tong-type yarn clamp 81, connected to a pair of clamping rollers 35, 36 in the direction toward the end of the yarn. The tong-type yarn clamp 81 can be applied to the area of the mouth 26 of the yarn withdrawal duct 25 from below, i.e., from below the component 27*e* having the false-twisting edges 29. The yarn clamp 81 is constructed to be narrow and has the shape of a beak, and includes two tong arms 82, 83 of which one is held so that it can be swivelled with respect to the other arm around a shaft 85. The swivable tong arm 83 is provided with a projection 86 that projects out at a right angle. A tension strip 87 is applied to the projection 86. The two tong arms 82, 83 form a clamping point 84 at their extreme ends. By means of a spring that is not shown, the tong arms 82, 83 are loaded in the direction of the clamping point 84.

As shown in FIG. 10, the yarn 5' to be returned is returned in a direction that deviates from the moving path of the yarn existing during the spinning operation. As soon as the yarn clamp 81 has arrived in the area of the component 27*e* and in the area of the mouth 26 of the yarn withdrawal duct 25, the two tong arms 82, 83 are released by the actuating of the tension strip 87, so that the yarn end 40 is sucked into the yarn withdrawal duct 25. The two clamping rollers 35, 36 are then driven in the return delivery direction.

As also shown in FIG. 10, component 27*e* with the false-twisting edges 29 is developed as a wheel that contains the false-twisting edges 29 at a groove base of a ring groove. Component 27*e* is held on a shaft 28 so that it can be rotated and also fixed. The false-twisting edges 29 project out different distances in different areas, so that it is possible to adjust different false-twisting effects by the rotating of the component 27*e*.

In the embodiment according to FIG. 10, a collecting plate 30 is also mounted at the covering 31 below the component 27*e* by which rubbed-off yarn parts are collected. These rubbed-off yarn parts can, for example, be sucked off by the movable servicing device 12 shown in FIG. 1. This cleaning occurs before a start spinning or at other suitable regular intervals by a trunk-type or pipe-type suction device applied to this area through the window-type recess 32.

As shown by the cross-sectional view in FIG. 11, the window-type recess 32 has a relatively large width only in the area in which the yarn clamp 81 is inserted. In the area that is located above the yarn clamp 81, the window-type recess 32 has the shape of a narrow slot 88 that in upward direction is limited by a yarn guide 33.

Figure 12:
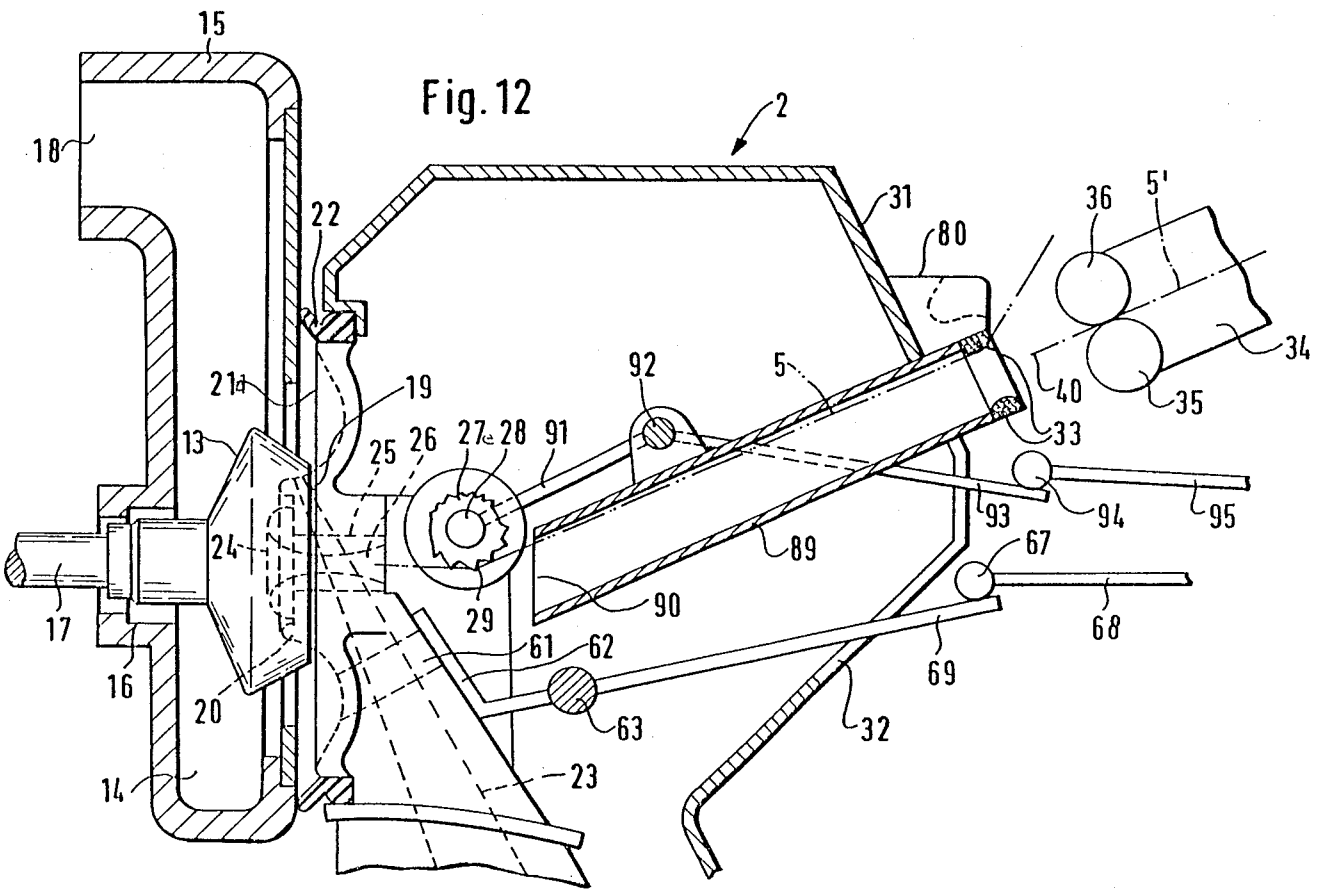
FIG. 12 is a partial cross-sectional view of another embodiment of a spinning unit with a component that can be moved between a spinning position and a piecing position which contains the false-twisting edges.

In the embodiment according to FIG. 12, a guiding element in the shape of a large-volume pipe piece 89 is arranged between the component 27*e* having the false-twisting edges 29 and the area outside the covering 31. The outer end of this pipe piece 89 is provided with a yarn guide 33, that is made of a ceramic material, for example, and that forms a deflecting point for the yarn 5 moving to the withdrawal device. A suction opening 61 is provided in the lid 21*a* directed toward the extension of the pipe piece 89, which is connected with the vacuum chamber 14 of the rotor housing 15. This suction opening 61 is closed by a flap 62 that can be swivelled around a shaft 63. The flap includes an arm 69 extending into the area outside the covering 31 which pivots the flap 62 away from the suction opening 61 when pushed by element 67, 68.

During a piecing operation, the devices 34 for the returning of a yarn 5' first return a sufficient yarn length by driving the pair of clamping rollers 35, 36 in return delivery direction. The flap 62 is opened, so that the yarn 5' is sucked into the pipe piece 89. As soon as the yarn end 40 leaves the end 90 of the pipe piece 89 and arrives in proximity of the mouth 26 of the yarn withdrawal duct 25, the flap 62 is closed. The suction air flow then only operates in the area of the mouth 26 of the yarn withdrawal duct 25, which provides that the yarn end 40, that is continuously furnished back by the pair 35, 36 of clamping rollers, is sucked into the yarn withdrawal duct 25.

In order that the component 27*e* with the false-twisting edges 29 does not impair the returning of the yarn end 40 to the yarn withdrawal duct 25, the component 27*e* is swivelled from the shown operating position into a piecing position during the return of the yarn end 40. In the piecing position, the false-twisting edges 29 are located outside the normal moving path of the yarn. In order to make this possible, the component 27*e* is arranged on a lever 91 that can be swivelled around a shaft 92 and that projects out of the covering 31 with an arm 93. A thrust piece 94 can swivel arm 93, and thus swivel lever 91 and the component 27*e* into the piecing position. The operating position of the component 27*e* is secured by a spring and a stop that are not shown in detail.

Figures 13, 14:
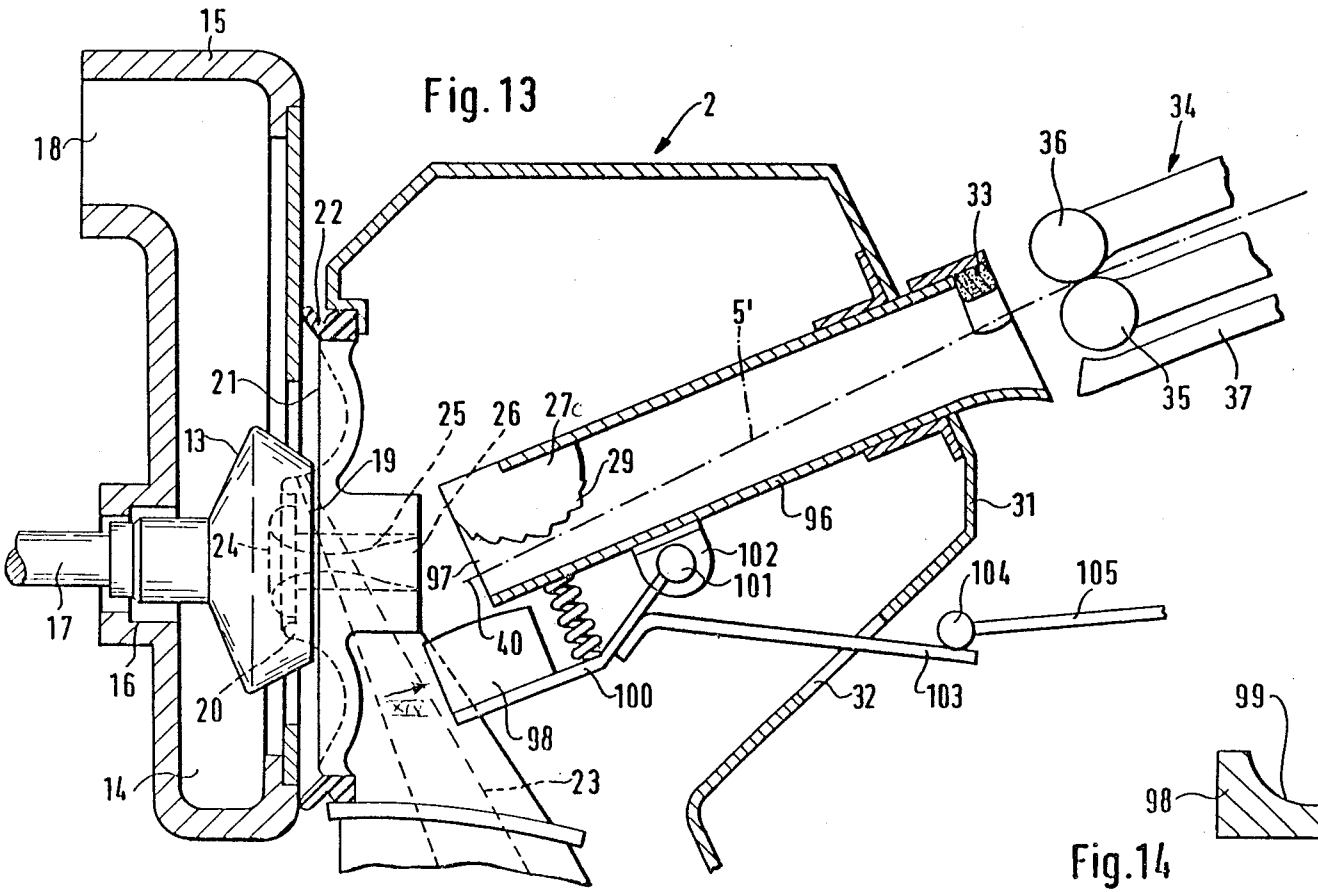
FIG. 13 is a partial cross-sectional view of another embodiment of the invention in which the component having the false-twisting edges is mounted at a guiding tube, and in which a connecting piece is provided that can form an essentially airtight seal inserted between the yarn withdrawal duct and the guiding tube.
FIG. 14 is a cross-sectional view of the closing piece of FIG. 13 taken from the direction of arrow XIV in FIG. 13.

In the embodiment according to FIG. 13, the yarn withdrawal duct 25 is followed by a guiding tube 96 that is arranged sloped with respect to the axis of the yarn withdrawal duct 25. A gap is disposed between the duct 25 and the guiding tube 96. At its inlet end 97, the guiding tube 96 is equipped with the component 27*c* constructed as an insert that has the false-twisting edges 29. At its outlet end, the guiding tube 96 is equipped with a yarn guide 33. Rubbed-off yarn pieces that are created during the normal spinning operation in the area of the false-twisting edges 29 can fall out of the open inlet end 97 of the guiding tube 96.

For a piecing operation, a yarn 5' is furnished back into the yarn withdrawal duct 25 and from there back into the spinning rotor 13. The yarn 5' is first applied to the outlet end of the guiding tube 96 by the devices 34 that are a component of a servicing device. By the drive of the pair of clamping rollers 35, 36, the yarn 5' is then furnished back, which is promoted by an injection nozzle 37 blowing an air current into the guiding tube 96. In order to apply the end 40 of the returning yarn 5' to the yarn withdrawal duct 25, the distance between the mouth 26 of the yarn withdrawal duct 25 and the guiding tube 96 is bridged by a closing piece 98. This closing piece 98 is arranged on a lever 100 that can be swivelled around a shaft 101 of a holding device 102 fastened on the guiding tube 96. The lever 100 is held in the shown operating spinning position by a spring and is equipped with a lever arm 103 that projects through a recess 32 of a covering 31. An actuating lever 105 including a thrust piece 104 of the servicing device 12 can be applied to actuating lever 103, so that the closing piece 98 can be brought into the piecing position by lever 100.

As shown in FIG. 14, the closing piece 98 has an approximately semi-cylindrical guiding surface 99.

In certain preferred embodiments, the machine shown in FIG. 13 is modified such that the distance between the guiding tube 96 and the yarn withdrawal duct 25 can be closed off in an airtight way forming a duct for the returning yarn 5'. This may take place, for example, by providing a two-part closing piece that includes two closing elements than can be applied from the side and that are arranged on a joint application or actuation mechanism. These closing elements may be made of an elastic material or may have elastic sealing elements, by means of which they are sealingly placed against the guiding tube 96 and against the projection of the lid 21 that contains the yarn withdrawal duct 25 thereby forming an essentially airtight seal.

In the case of further contemplated, modified embodiments, it is provided that the deflecting component with the false-twisting edges 29 is arranged on an adjusting mechanism and can be moved between a spinning position and a piecing position, so that the deflecting component can be moved completely out of the area of an extension of the yarn withdrawal duct 25. This area can then be bridged by two closing elements that can be applied from the side, for example, while forming a duct-type guide. In this case, it is also possible to provide a guiding tube that only has a diameter corresponding to the diameter of the yarn withdrawal duct 25 instead of the guiding tube 96 having a relatively large diameter. Thus, by means of the closing elements, conditions can be created for the piecing that form a completely closed duct between the yarn withdrawal duct 25 and the yarn guide 33 that corresponds to the conventional yarn withdrawal tube in its dimensions.

Figure 15:
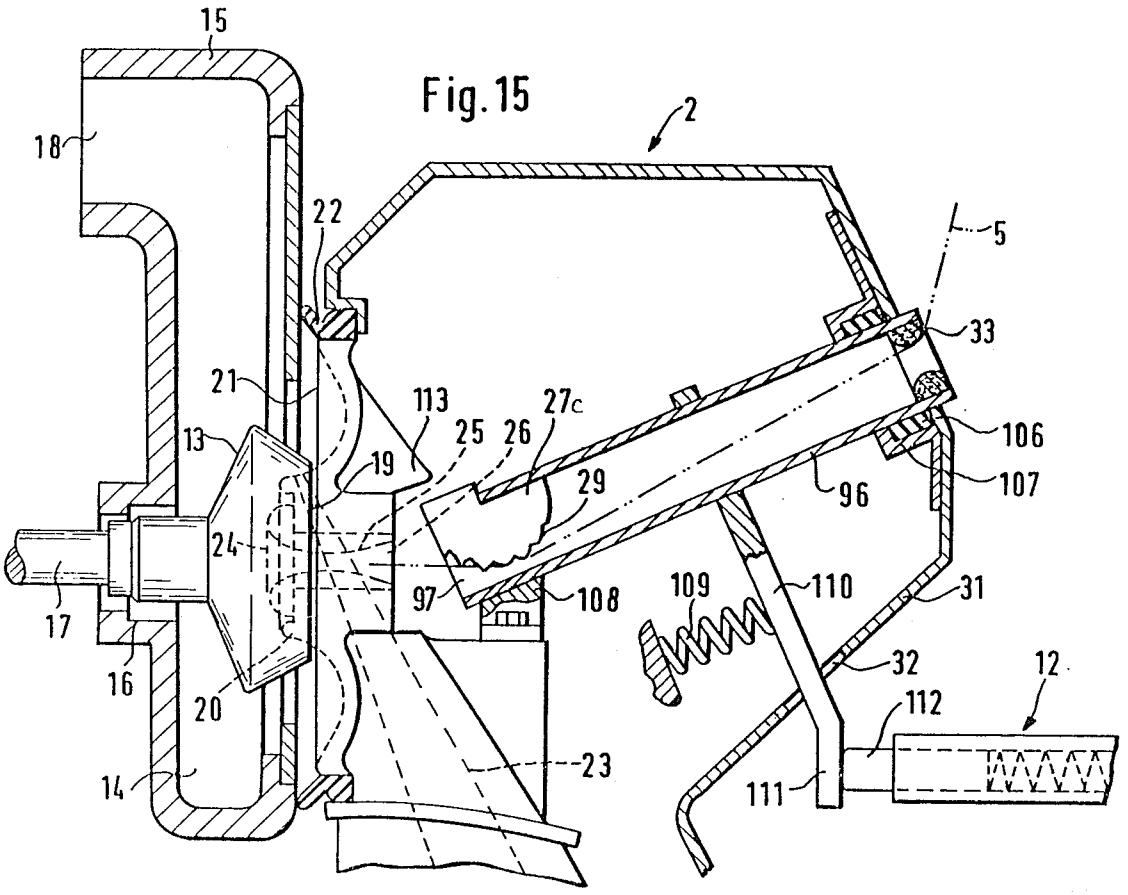
FIG. 15 is a partial cross-sectional lateral view of another embodiment having an adjustable guiding element shown in a spinning position.
Figure 16:
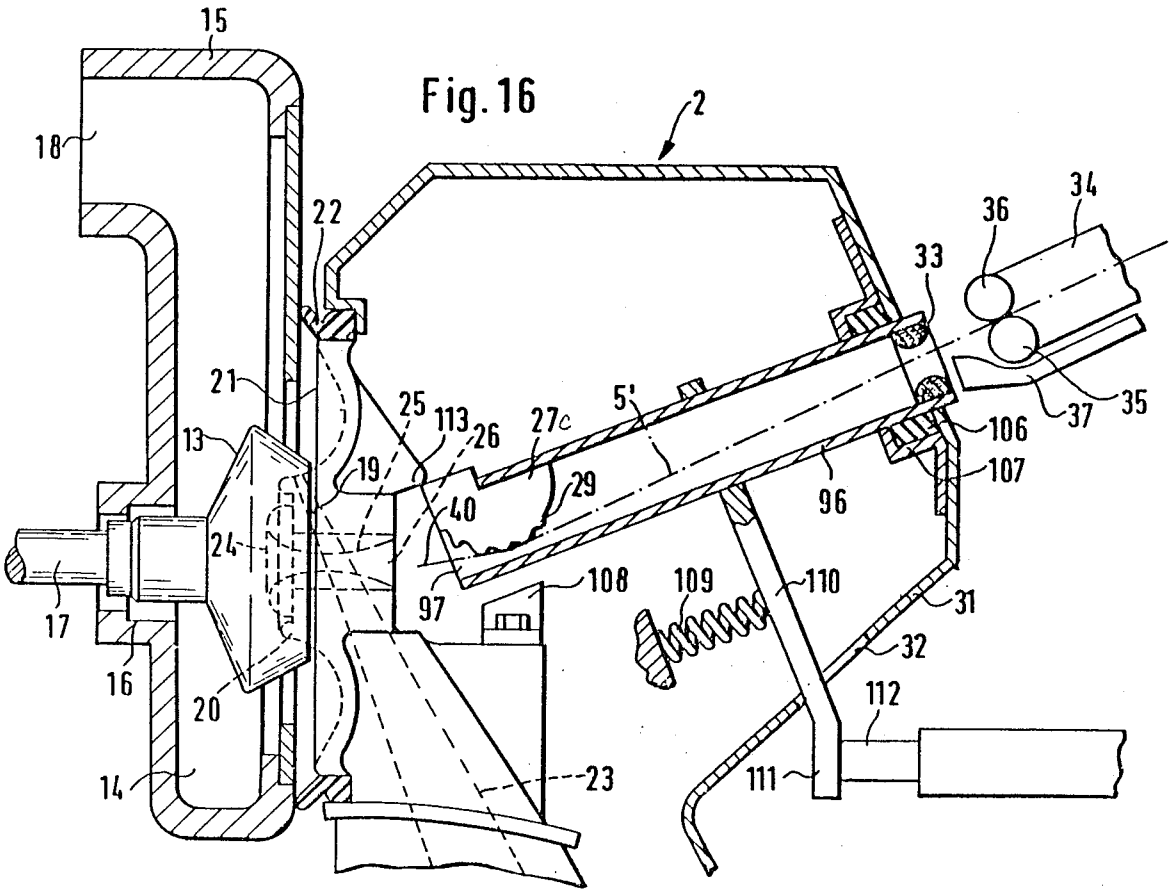
FIG. 16 is a partial cross-sectional view of the embodiment according to FIG. 15 in a piecing position.

In the embodiment according to FIGS. 15 and 16, a sloped guiding tube 96 is connected behind the horizontal yarn withdrawal duct 25 that extends coaxially to the shaft of the spinning rotor 13. A gap is disposed between the guiding tube 96 and withdrawal duct 25. The guiding tube 96 is provided with a component 27c that has false-twisting edges 29 in the area of its inlet end 97, which project into the moving path of the yarn 5 and forms a deflecting point. The outlet end of the guiding tube 96 is equipped with a ring-shaped yarn guide 33 forming another deflection. In the area of its outlet end, the guiding tube 96 is held pivotably at the covering 31. For this purpose, the end of the guiding tube 96 is clamped into a membrane 106 of a rubber-elastic material that is held by means of a pot-shaped holding device 107. The holding device 107 is fastened at the covering 31 and possibly also at the guiding tube 96. The holding device may be made of an elastic material. At the guiding tube 96, a lever 110 is mounted that is loaded with a pressure spring 109 in such a way that the area of the inlet end 97 of the guiding tube 96 is pressed against a stop 108 that is mounted at a projection of the lid 21 of the rotor housing 15. The stop 108 advantageously has a prismatic stop surface.

The guiding tube 96 can be swivelled out of the operating spinning position (FIG. 15), by means of an actuating device 112 of the servicing device 12 that acts upon the end 111 of the lever 110 projecting out of the covering 31. In the piecing position (FIG. 16), the guiding tube 96 or the component 27c rests against a stop 113 of the lid 21. The guiding tube 96 is then swivelled in such a way that the gap existing in the area of the inlet end 97 between the guiding tube 96 and the false-twisting edges 29 of the component 27 is located approximately as an extension of the yarn withdrawal duct 25. In this position, the devices 34 for the feeding of a yarn 5' are applied to the outlet end of the guiding tube 96. These devices 34 have a pair of clamping rollers 35, 36 that can be driven in return delivery direction and can be moved apart, and include an injection nozzle 37, the blowing direction of which is directed into the guiding tube 96.

Figure 18:
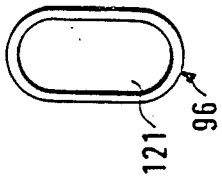
FIG. 18 is an end view of the tube-shaped guiding element of FIG. 17 taken from line XVIII.
Figure 17:
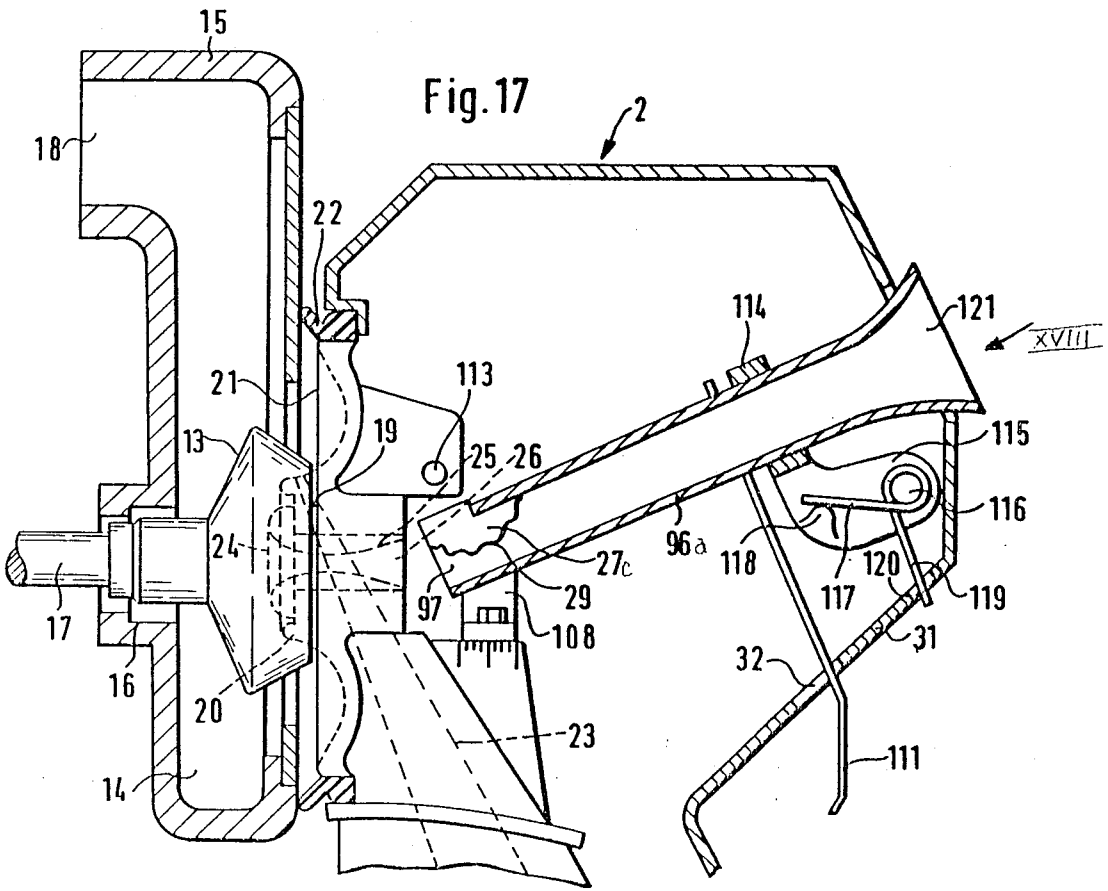
FIG. 17 is a partial cross-sectional view of another preferred embodiment of the invention.

In its basic construction, the embodiment according to FIGS. 17 and 18 is similar to the embodiment according to FIGS. 15 and 16. Connected behind the yarn withdrawal duct 25 is a guiding tube 96a. In the area of an inlet end 97 of the withdrawal duct 25, a component 27c having false twisting edges 29 is provided. The guiding tube 96a has an oval cross-section and is expanded in the shape of a funnel at its outlet end 121. The guiding tube 96a is held at the covering 31 by a holding device 115 having ring guide 114 which reaches around the guiding tube 96a. The guiding tube 96a can be swivelled around a shaft 116. A leg spring is wound around the shaft 116, of which one leg 117 rests against a projection 118 of the holding device 115, while the other leg 119 engages in a recess 120 of the covering 31. By means of this leg spring 117, 119, the holding device 115 together with the guiding tube 96a are swivelled in such a way that in an operating position the guiding tube 96a rests against a stop 108 that is mounted at the lid 21. The stop 108 has a prismatic stop surface for the guiding tube 96a, and is fastened so that it can be adjusted in parallel to the shaft of the yarn withdrawal duct 25. This adjustment permits adjusting the immersion depth of the false-twisting edges 29 of the component 27 into the moving path of the yarn. In order to be able to carry out repeatable adjustments, a scale is mounted at the projection of the lid 21.

At the guiding tube 96a, an actuating lever 111 is mounted that is constructed as a sheet-metal bracket. This actuating lever 111 is guided out through a recess 32 of the covering 31, and an actuating element (compare actuating element 112 of FIG. 15, 16) of a movable servicing device 12 can be applied to the actuating lever 111. By means of this actuating element, the guiding tube 96a can be swivelled away from the stop 108, so that the false-twisting edges 29 can be moved out of the area extending out of the yarn withdrawal duct 25 into a piecing position. This piecing position is secured by means of a stop 113 that is also mounted at the lid 21.

Figure 19:
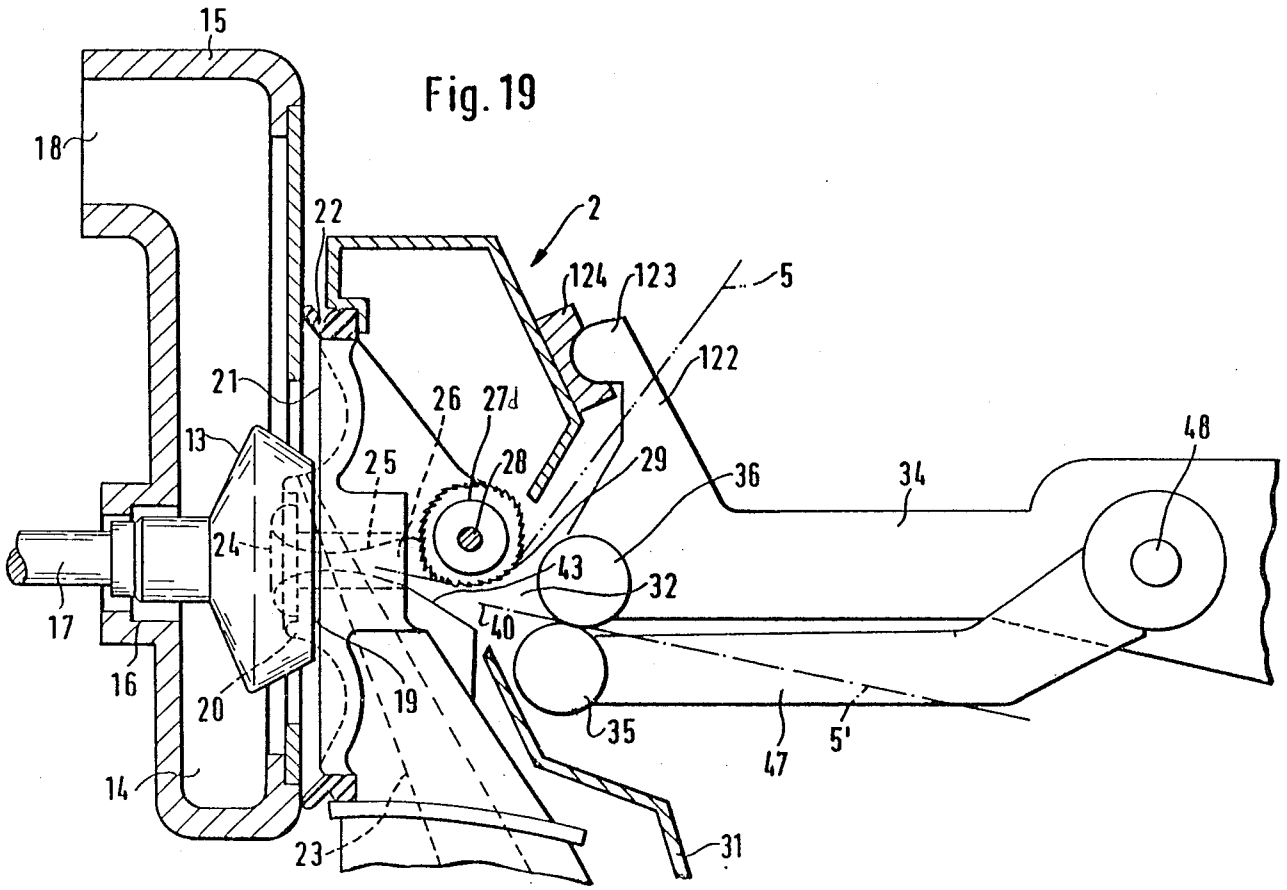
FIG. 19 is a partial cross-sectional lateral view of certain preferred embodiments of a spinning unit at which devices for the returning of a yarn end are operating.

In the embodiment according to FIG. 19, the short, straight yarn withdrawal duct 25, that extends horizontally corresponding to the shaft of the spinning rotor 13, is only followed by the component 27d including the false-twisting edges 29. In the case of this embodiment, any other yarn guiding elements for the yarn 5 moving upward to a withdrawal device are not included. A guiding surface 43 of the lid 21 is located below the component 27d, which is directed diagonally to the outside and on which rubbed-off yarn pieces can slide off in downward direction. Continued past the guiding surface 43, is a surface of a covering 31 that also extends diagonally. The covering 31 is indented toward the area of the component 27*d* and has a recess 32 in this area. The indentation and the recess 32 of the covering 31 are constructed in such a way that the area located below component 27*d* and thus the mouth 26 of the yarn withdrawal duct 25 are accessible from the outside. Therefore, it is possible to apply the end 40 of a yarn 5' to be returned for the piecing almost directly to the mouth 26 while bypassing component 27*d*.

For the returning of the yarn 5', devices 34 of a movable servicing device 12 are used. The devices 34 include a pair of clamping rollers 35, 36 that can be driven in yarn return direction. The clamping roller 35 is disposed on a lever 47 that can be swivelled around a shaft 48, so that the two clamping rollers 35, 36 can be moved apart for the release of the returning yarn 5'. The end 40 of the returning yarn 5' is thus located directly in the suction area of the yarn withdrawal duct 25.

As shown clearly in FIG. 19, the return direction of the yarn end 40 deviates from the normal moving spinning direction of the spun yarn 5 which is deflected upwardly in the area of the false-twisting edges 29 of the component 27*d*.

In certain preferred embodiments, deviating from the embodiment according to FIG. 19, it is also contemplated to connect the deflecting component to the yarn withdrawal duct 25 in a sealing way so that in the area of the diagonal surface 43, a suction opening exists that is connected tightly with the yarn withdrawal duct 25. In the case of a further contemplated modification of the embodiment according to FIG. 19, it can be provided that the deflecting component is held on an adjusting mechanism in such a way that it can be moved from the shown operating position into a piecing position, in which the mouth 26 of the yarn withdrawal duct 25 is exposed. For this purpose, the deflecting component can be movable in upward direction or toward the side (laterally).

As also shown in FIG. 19, the devices 34 for the returning of a yarn 5' are provided with a projection 122 having a nose 123 that engages in a recess of a centering piece 124 that is fastened at the covering 31. As a result, the devices 34 for the application of the pair of clamping rollers 35, 36 to the spinning unit 2 are centered in their piecing position.

Figure 20:
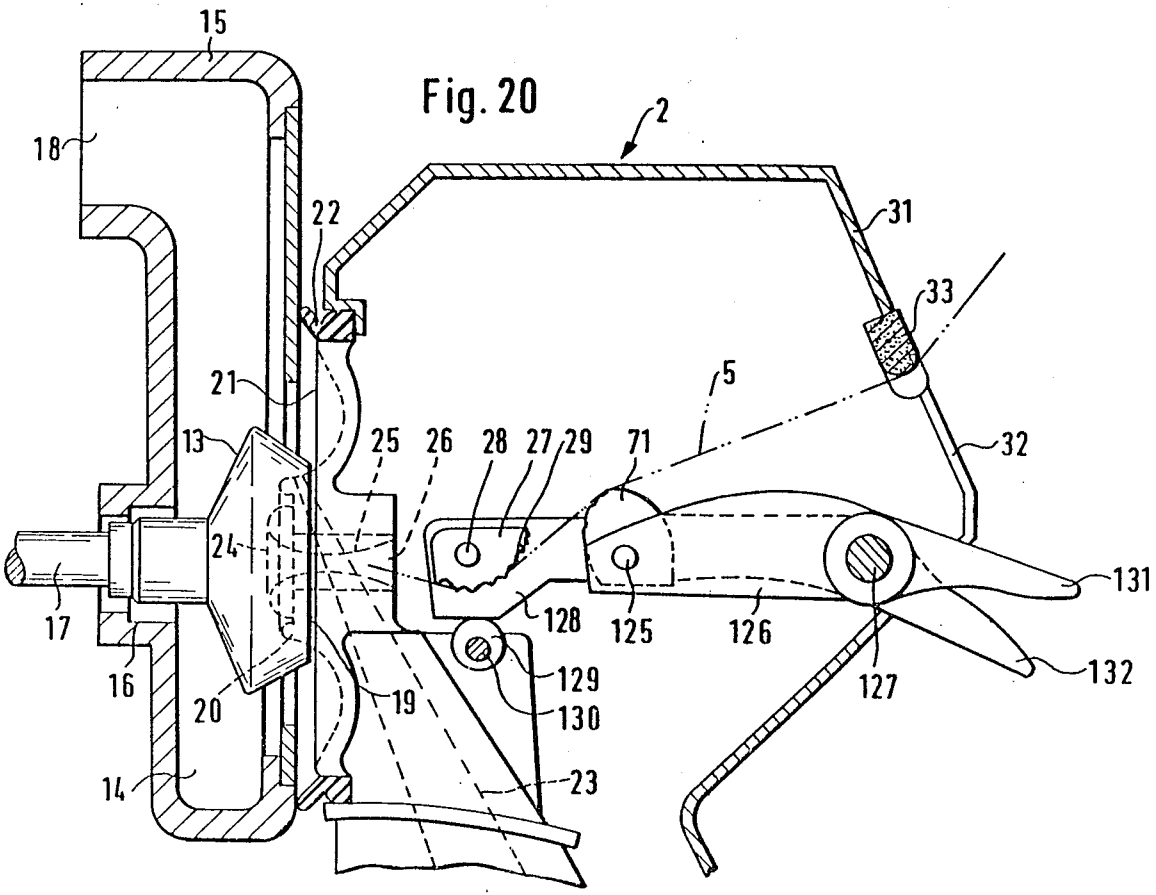
FIG. 20 is a partial cross-sectional lateral view of certain preferred embodiments of a spinning unit in an operating spinning position.
Figure 21:
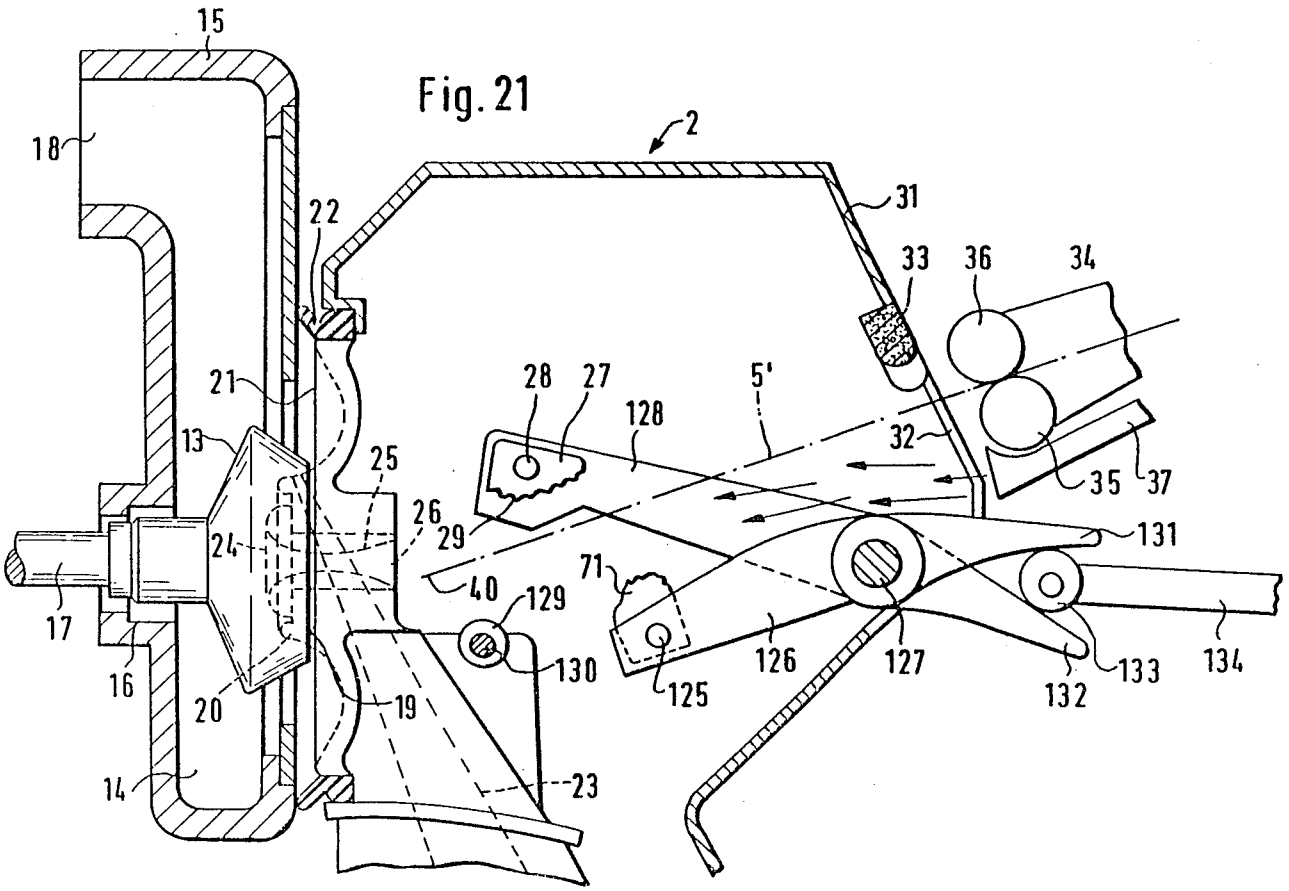
FIG. 21 is a partial cross-sectional lateral view of the spinning unit according to FIG. 20 in a piecing position during a piecing operation.

In the embodiment according to FIGS. 20 and 21, a component 27 having false-twisting edges 29 is connected behind the yarn withdrawal duct 25 and forms a first deflection of the yarn 5 to be spun. Another deflection takes place in the area of a yarn guide 33 that is arranged in a recess 32 of a covering 31, after which the yarn 5 moves diagonally upward to a withdrawal device that is not shown. Between the component 27 and the yarn guide 33, the yarn 5 is also deflected by another component 71 in order to reinforce the deflection at the component 27. This component 71 may also be equipped with false-twisting ribs, and in certain preferred embodiments is advantageously made of a ceramic material.

The components 27 and 71 are each arranged detachably on bolts 28, 125, which in turn are arranged on scissor-type arms 126, 128. The two scissor-type arms 126, 128 can be swivelled around a shaft 127 mounted at the covering 31. Ends 131, 132 of the arms 126, 128 extend to the outside through the covering 31. In the area of the swivel shaft 127, spring elements are provided that are not shown which hold the two scissor-type arms 126, 128 in the operating spinning position shown in FIG. 20. In the operating spinning position, the scissor-type arm 128 rests on a stop 129 that is mounted at a projection of the lid 21 of the rotor housing 15. This stop 129 is constructed as an eccentric ring that can be adjusted around a shaft 130, so that the immersion depth of the false-twisting edges 29 of the component 27 into the moving path of the yarn can be adjusted.

For a piecing process, the two scissor-type arms 126, 128 are swivelled apart, as shown in FIG. 21. For this purpose, a thrust piece 133 of an adjusting element 134 of a servicing device is inserted between the two ends 131, 132 projecting out of the covering 31. The two scissor-type arms 126, 128 are thereby moved apart against the effect of the spring element. As a result, the components 27 and 71 are moved well out of the moving path of the yarn. In this piecing position, a yarn 5' to be returned can be applied to the yarn withdrawal duct 25. This returning takes place by means of devices 34 of the movable servicing device 12 that include a pair of clamping rollers 35, 36 that can be driven at least in return direction and that can be moved apart. The devices 34 also include an injection nozzle 37 by means of which a blowing air current is generated in the direction of the yarn withdrawal duct 25.

Figures 22, 23:
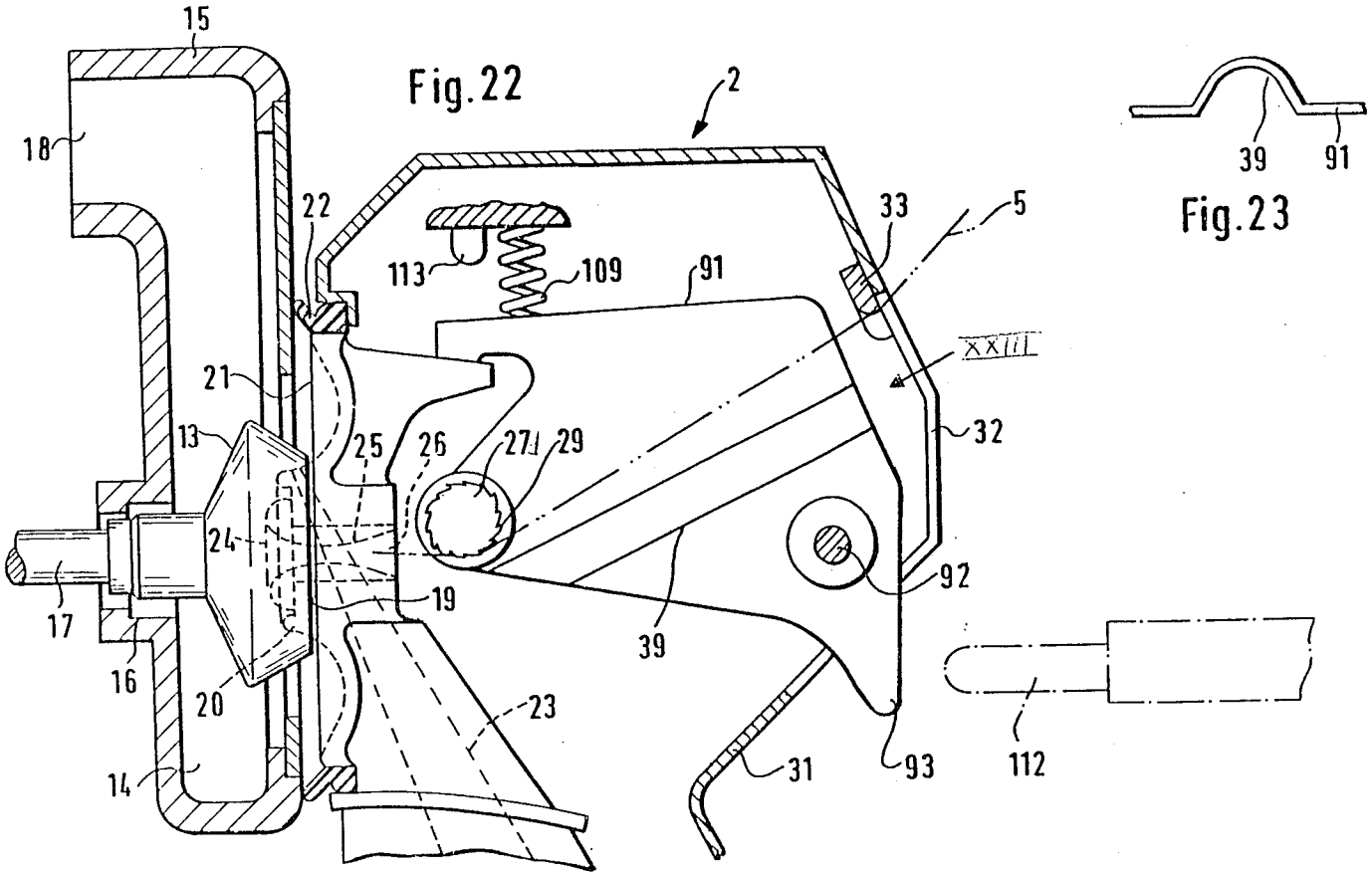
FIG. 22 is a partial cross-sectional lateral view of another preferred embodiment of an open-end spinning unit in which a guiding element and a component having false-twisting edges can be adjusted between a shown operating position and a piecing position by a joint holding device.
FIG. 23 is a partial end view of the guiding element of FIG. 22 taken from arrow XXIII.

In the case of the embodiment according to FIGS. 22 and 23, a guiding element 91 is disposed inside the covering 31. This guiding element 91 has a deflecting component 27*d* with the false-twisting edges 29 that is connected behind a yarn withdrawal duct 25, and further includes a groove-shaped guiding duct 39 for a yarn end to be returned. The guiding element 91 has an essentially plate-shaped design and can be swivelled around a shaft 92 that extends essentially transversely to the yarn withdrawal duct 25. By means of a pressure spring 109, the guiding element 91 is held in the shown operating spinning position in which it rests against a stop of the lid 21 with a nose. The guiding element 91 is provided with a projection that projects out of the covering 31 in the manner of a lever, and to which an actuating element 112 of a servicing device can be applied. The guiding element 91 is thereby swivelled clockwise against the effect of the pressure spring 109 to a stop 113 in a piecing operation. By means of this swivelling, the deflecting component 27*d* is moved out of the area of the extension of the yarn withdrawal duct 25, while at the same time, the groove-type guide 39 is applied to the yarn withdrawal duct 25. The guide 39 can be formed of a sheet metal plate, for example. In this embodiment, it is therefore possible to apply a returning yarn end to the yarn withdrawal duct 25 using a blowing air current, and the yarn end is aligned by the groove-type guide 39.

Figure 25:
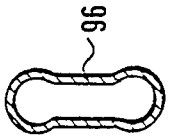
FIG. 25 is a cross-sectional view of the guiding element of the embodiment according to FIG. 24 taken along lines XXV—XXV of FIG. 24.
Figure 24:
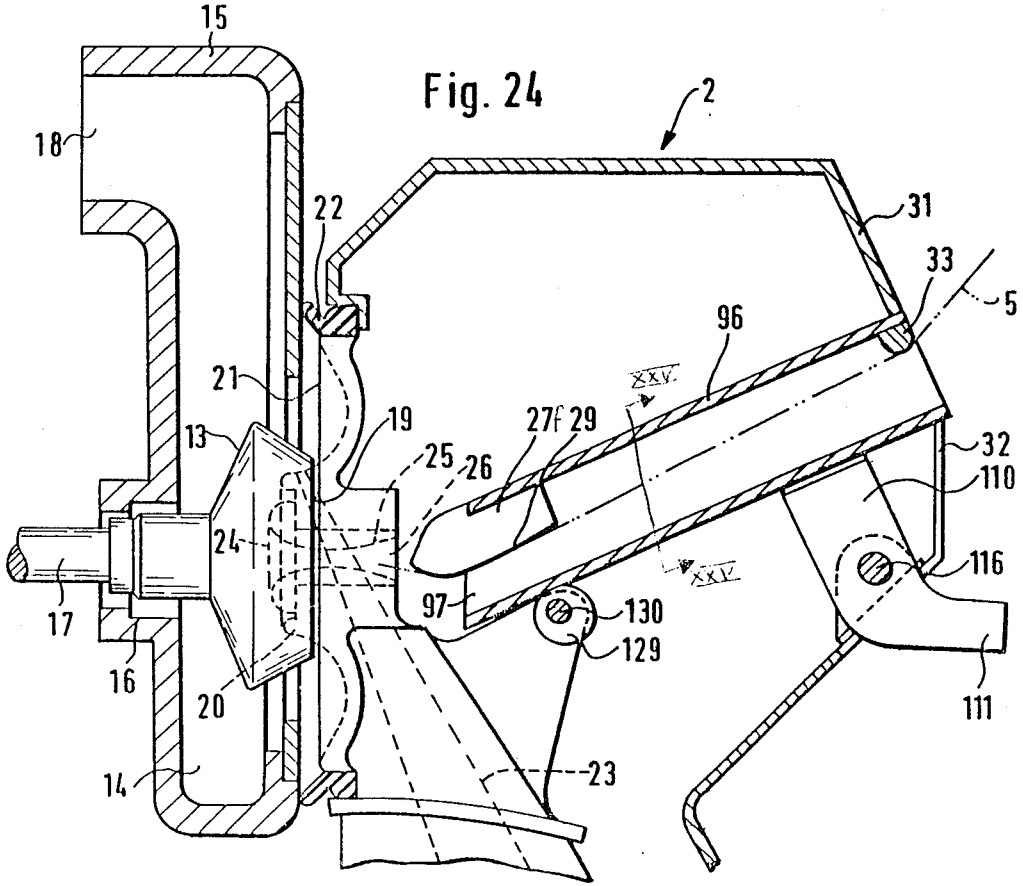
FIG. 24 is a partial cross-sectional lateral view of certain preferred embodiments of a spinning unit having a tube-shaped guiding element that includes a component having false-twisting edges and that can be swivelled between a piecing position and a spinning position.
Figure 26:
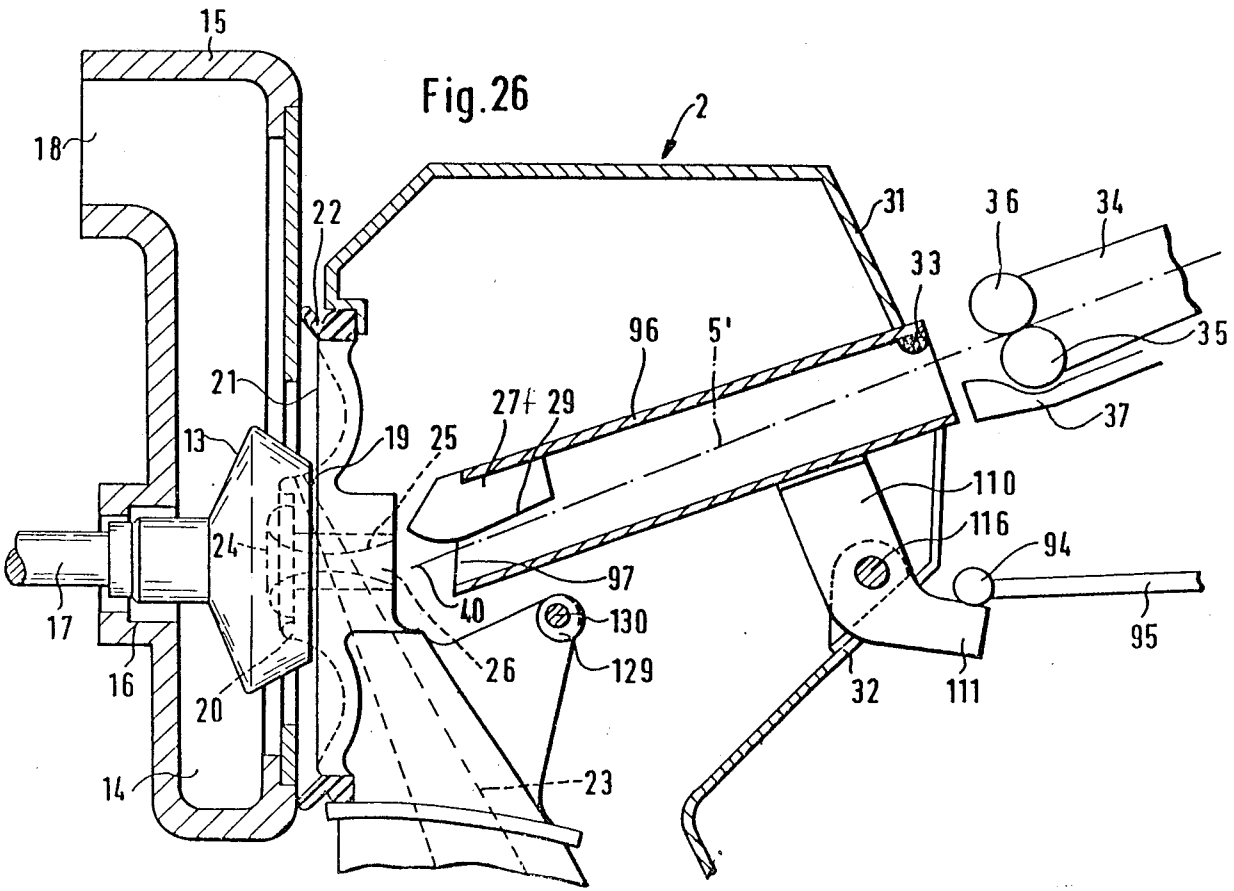
FIG. 26 is the arrangement according to FIG. 25 in a piecing position with the feeding device of a servicing device that is applied to the guiding element.

In the embodiment according to FIGS. 24 to 26, a guiding tube 96 is arranged behind the yarn withdrawal duct 25. This guiding tube 96 is sloped upward with respect to the horizontally disposed yarn withdrawal duct 26. In the area of its inlet end 97, this guiding tube 96 is provided with a component 27*f* having false-twisting edges 29. In the area of its outlet end, a yarn guide 33 is arranged at which a further deflection takes place. By means of a holding device 110, the guiding tube 96 can be swivelled around a shaft 116. The end 111 of the holding device 110 projects out of the covering 31, and is therefore accessible to an actuating element 94, 95 of a servicing device. The operating spinning position (FIG. 24) of the guiding tube 96 is secured by a spring that is not shown that presses the guiding tube 96 against an eccentric pulley 129 that can be adjusted around a shaft 130 such that the operating position of the guiding tube 96 is adjustable.

The guiding tube of FIGS. 24 and 25, according to FIG. 26, can be swivelled into a piecing position from the shown operating spinning position of FIG. 24 in such a way that the gap between the component **27*f* and the opposite tube wall in the area of the inlet end 97 is located essentially as an extension of the yarn withdrawal duct 25. As shown in FIG. 25, the guiding tube 26 has the shape of two tube portions that extend in parallel to one another and are connected by means of a slot. In certain preferred embodiments, the slot must have a cross-section that only permits a passage of the yarn 5, i.e., the slot can be developed to be significantly smaller than shown in FIG. 25. In the area of the inlet end 97, the upper tube portion is closed off by the component 27*f* so that only the lower tube portion of the guiding tube 96 is effective (allows passage of the yarn). Also in this embodiment, it is provided that between the mouth 26 of the yarn withdrawal duct 25 and the guiding tube 96, a gap is disposed such that rubbed-off yarn pieces can fall down and be moved away. When a yarn end 5' is returned, as shown in FIG. 26, a blowing nozzle 37 is used advantageously in connection with a pair of clamping rollers 35, 36**.

Figure 27:
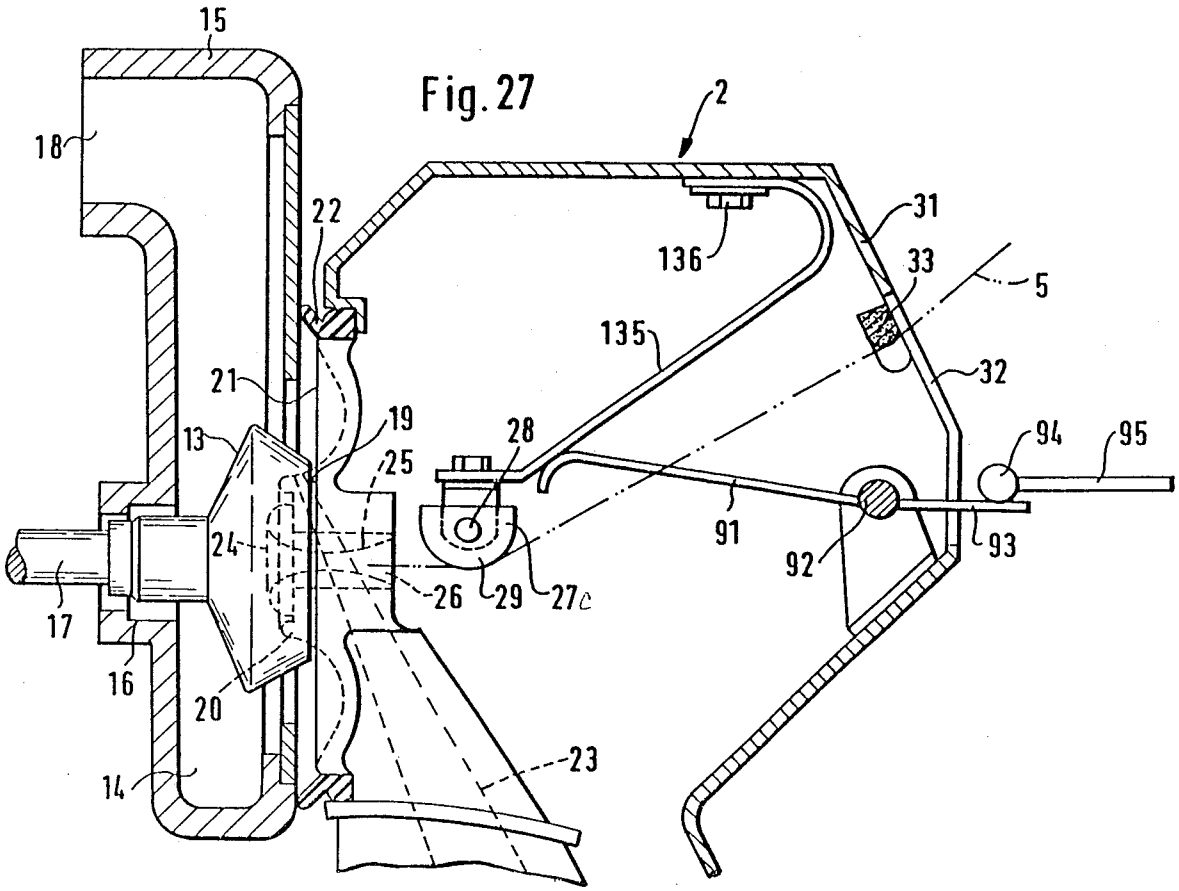
FIG. 27 is a partial cross-sectional lateral view of another preferred embodiment of a spinning unit with a component containing false-twisting edges that be moved from the spinning position into a piecing position.

In the embodiment according to FIG. 27, a deflecting component **27*c* is provided with false-twisting edges 29 that is connected behind the short yarn withdrawal duct 25 extending in the direction of the shaft of the spinning rotor 13. The deflecting component is held by a leaf spring 135 that is fastened at the covering 31 by a screw 136 or the like. The leaf spring 135 is developed in such a way that it is excited to carry out slight vibrations with low amplitudes on the basis of machine vibrations. As a result, the effect of the false-twisting edges 29 is made more uniform and is possibly also reinforced. Because of these vibrations, not only are the rubbed-off yarn pieces detached from the spun yarn 5, but dirt that may be adhering to the spun yarn 5** may possibly also be removed.

Since the deflecting component **27*c* is completely exposed, rubbed-off yarn pieces and dirt can fall down and can be removed. For a returning of a yarn end during the piecing, the elastically held component 27*c* can be moved out of the shown operating position against the effect of the leaf spring 135 in a simple way. In certain preferred embodiments, this movement of the deflecting component 27*c* can be achieved by devices on a servicing device, for example, by devices 34 corresponding to the embodiment shown in FIG. 19 and by devices 34 corresponding to FIGS. 10 and 11 which move against the deflecting component or the leaf spring 135 and move it and the deflecting component out of the operating position during the return of the yarn 5'**.

However, as shown in FIG. 27, it is also possible to move the deflecting component **27*c* out of the operating position into a piecing position by means of a separate actuating mechanism. For this purpose, a lever 91 is provided that can be swivelled around a shaft 92 and which is placed against the leaf spring 135. The lever 91 is equipped with an arm 93 that projects out of the covering 31 and to which an actuating element 95 with a thrust piece 94 of a servicing device can be applied. When the deflecting component 27*c* is moved out of the operating position, it is also contemplated in a simple way to control the returning of the yarn end simply by means of an injection nozzle or the like that generates a flowing air current that applies the yarn end to the yarn withdrawal duct 25**.

Figure 28:
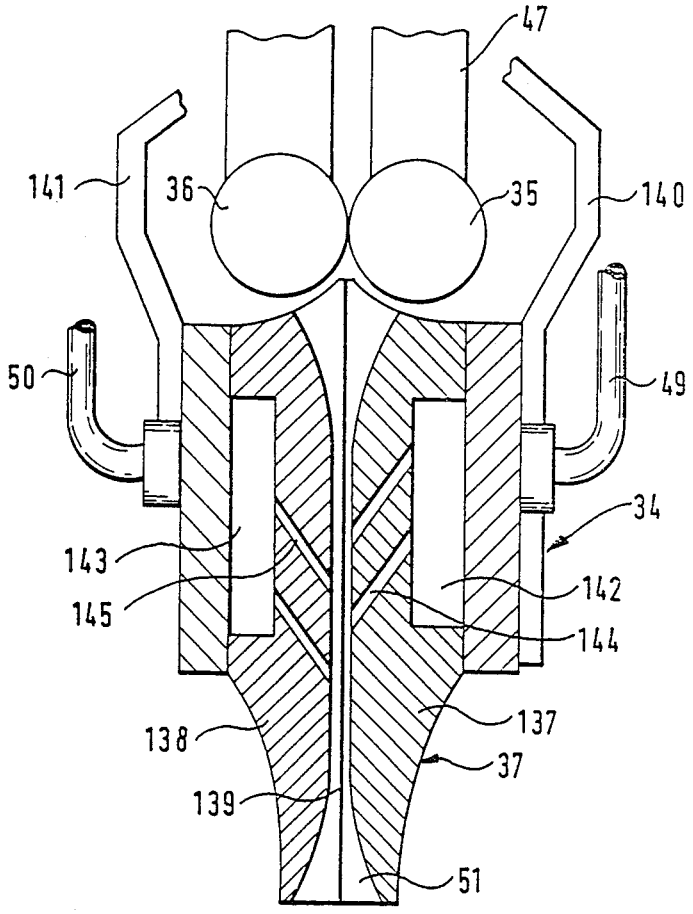
FIG. 28 is a partial cross-sectional view of a feeding device according to certain preferred embodiments of the invention including a pair of clamping rollers and an injection nozzle that is connected on an outlet side.

FIG. 28 shows an embodiment of an injection nozzle which can be used in any and all embodiments of the invention together with a pair of clamping rollers 35, 36 that can be driven at least in return delivery direction of a yarn and that can be moved apart. The injection nozzle 37 includes two halves 137, 138 that are divided by a dividing seam 139 extending as an extension of the clamping plane of the clamping rollers 35, 36. The two parts 137, 138 are each held by holding devices 140, 141 that are connected with the holding devices of the clamping rollers 35, 36. The two parts 137, 138 form a toroidal chamber 142, 143 from which injection bores 144, 145 which have a slope in conveying direction lead to a central passage duct. At its mouth 51, the conveying duct expands to the shape of a nozzle. Pressure supply lines 49, 50 lead to the toroidal chamber 142, 143. Instead of a surrounding toroidal chamber, two toroidal chambers 142, 143 may also be provided that are separated from one another at the dividing seam 139 and that are then supplied by means of their own respective pressure supply line 49, 50.

With a nozzle-shaped expansion on the end closest to the pair of rollers 35, 36, the guiding duct that is formed by the injection nozzle 37 extends into the area of the clamping line of the pair of clamping rollers 35, 36 so that the yarn end to be returned is received securely and moves securely into the duct. This occurs even if the yarn end was prepared in the shape of a fiber beard or brush, for example.

Figures 29, 30:
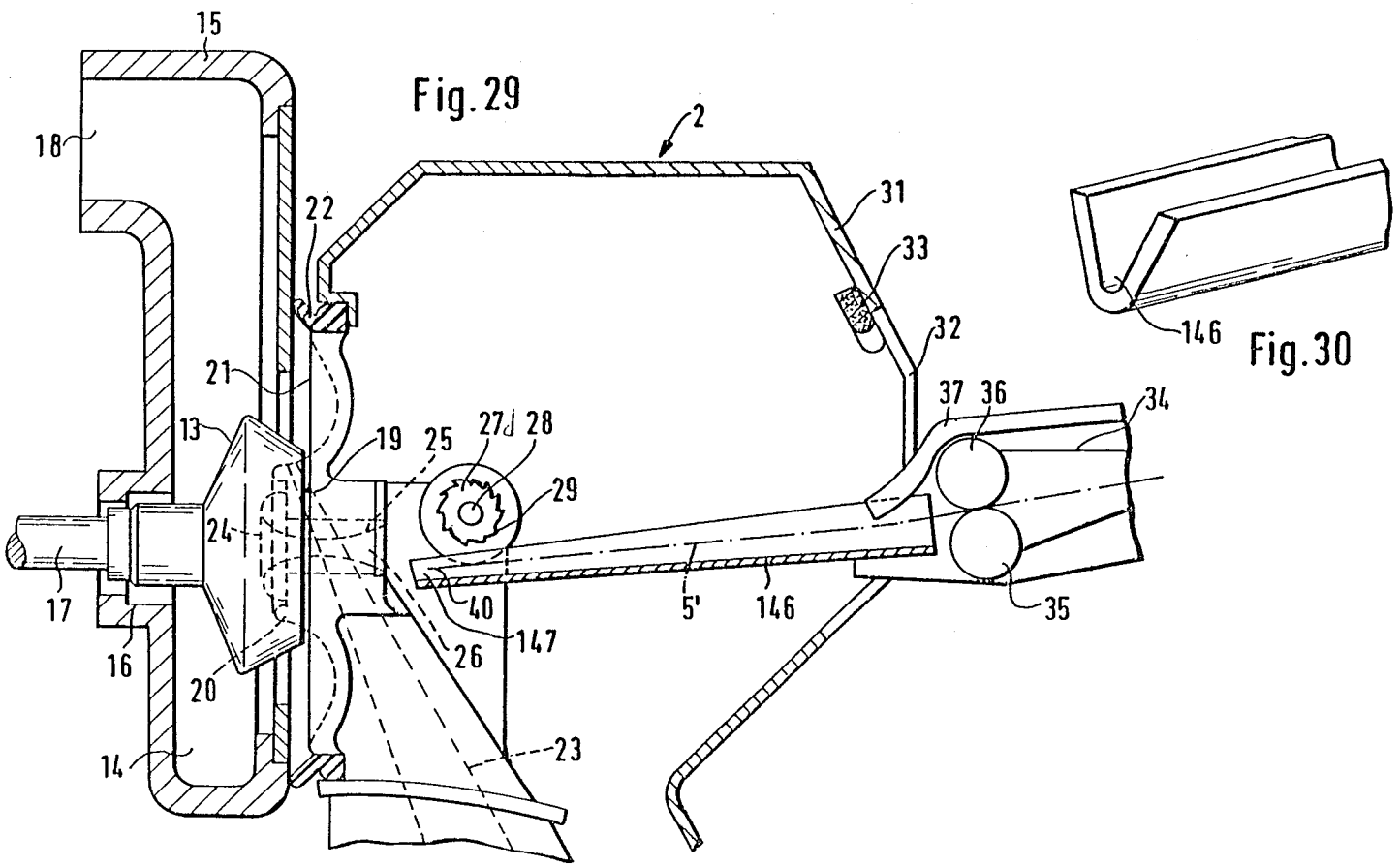
FIG. 29 is a partial cross-sectional view of certain preferred embodiments of a spinning unit and of a feeding device of a servicing device that contains a groove-shaped air-guiding element that can be applied to the yarn withdrawal duct.
FIG. 30 is an enlarged perspective view of a part of the air-guiding element of FIG. 29.

In the embodiment according to FIGS. 29 and 30, a deflecting component **27*d* with the false-twisting edges 29 is connected behind the yarn withdrawal duct 25 and is also located in the open. During the normal spinning operation (not shown), the yarn moves freely from the false-twisting edges 29 that form a deflection to a yarn guide 33 that is mounted at the covering 31**.

For the piecing, a groove-shaped air guiding element 146 is applied to the mouth 26 of the yarn withdrawal duct 25. This air guiding element 146 is a component of the devices 34 for the returning of a yarn 5' of the servicing device. This groove-shaped air guiding element 146 connects to the clamping rollers 35, 36. In the groove-shaped air guiding element 146, a blowing air flow is guided that is generated by an injection nozzle 37 which guides the end 40 of the returning yarn 5' to the mouth 26 of the yarn withdrawal duct 25. As shown in FIG. 29, the tapered, needle-like pointed end 147 of the air guiding element 146 is guided up close to the yarn withdrawal duct 25.

As a contemplated modification of the embodiment according to FIG. 29, it is provided that the deflecting component is arranged to be adjustable or flexible, for example, according to the embodiment of FIG. 27. In these embodiments, it is possible to move the deflecting component into a piecing position so that the air guiding element 146 can be applied directly to the yarn withdrawal duct 25.

Figure 31:
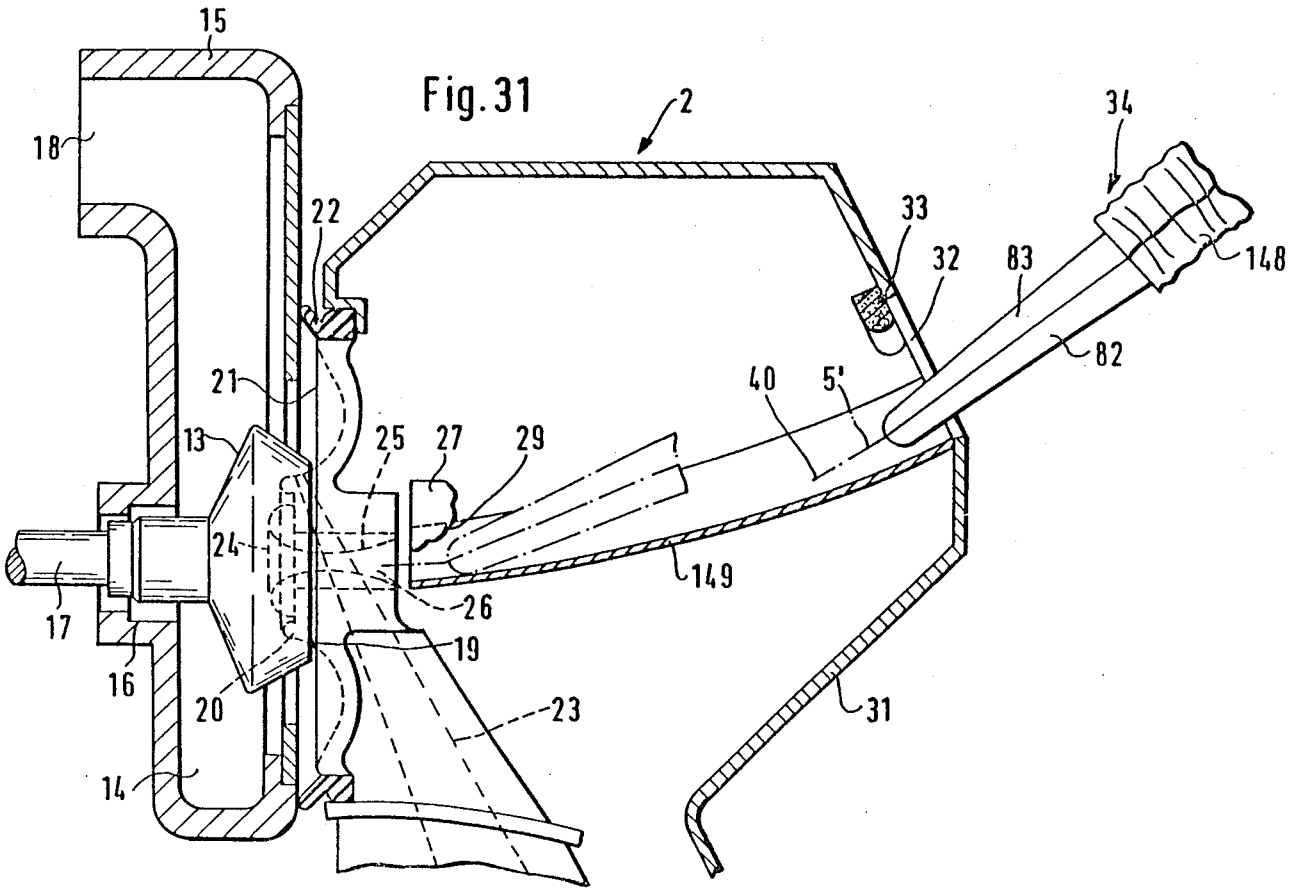
FIG. 31 is a partial cross-sectional view of certain preferred embodiments of a spinning unit that is equipped with a guiding element for applying a part of a feeding device of a servicing device to the mouth of the yarn withdrawal duct

In the embodiment according to FIG. 31, a gap is also provided between the yarn withdrawal duct 25 and the deflecting component 27 with false-twisting edges 29. In the area of the false-twisting edges 29, a deflection of the yarn to be spun takes place. The yarn is then guided freely to a yarn guide 33 that is fastened at a covering 31. In this embodiment, each spinning unit 2 is provided with a guiding path device 149 in the form of a guiding plate that is mounted at the covering 31. This guiding path device 149 has the purpose of precisely applying any of the yarn return guiding elements, such as a yarn clamp according to FIGS. 10 and 11 with tong arms 82, 83, or a guiding groove 146 according to FIG. 29, to the yarn withdrawal duct 25. For this purpose, the guiding element of the servicing device is kept correspondingly flexible.

Also in this embodiment, it is contemplated to adjust the deflecting component into a piecing position using adjusting devices. It is also contemplated to hold the deflecting component in the operating position by spring force, from which it can then be moved by the guiding element 82, 83, when the end 40 of the returning yarn 5' is applied.

A contemplated modification of the embodiments according to FIGS. 29 and 31, is to provide the ends of the air guiding element 146 or of the guiding elements 82, 83 with coupling parts, such as a magnet. The magnets of these elements can then be connected with corresponding counterparts in the area of the mouth of the yarn withdrawal duct 25 when moved into a piecing position. It is then possible to construct or keep the air guiding element 146 or the guiding elements 82, 83 at least somewhat flexible, because the magnets facilitate centering and engagement in the appropriate position.

Although specific types of deflecting components having false-twisting edges have been described in each of the preceding embodiments, it is contemplated that any of these deflecting components can be used for any embodiment of the present invention.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Open-end rotor spinning apparatus having at least one spinning unit having spinning surface means where yarn is formed, comprising:

yarn withdrawal duct means leading from said spinning surface means in a yarn withdrawal direction;

yarn deflecting means downstream from said yarn withdrawal duct means in the yarn withdrawal direction for deflecting yarn from said yarn withdrawal duct means in a yarn spinning path during spinning operations, said yarn deflecting means including at least one false-twisting edge; and yarn returning means for returning a yarn end to said yarn withdrawal duct means along a piecing path past said yarn deflecting means for piecing operations, wherein the relative position of the yarn deflecting means and the yarn path is different for the spinning and piecing operations.

2. Apparatus as in claim 1, wherein said spinning surface means are disposed at a spinning rotor disposed on a rotor shaft, and further including a rotor housing connected to a vacuum source surrounding said spinning rotor and a lid included on said rotor housing, said yarn withdrawal duct means being disposed in said lid of said rotor housing aligned along a withdrawal duct means axis common with said rotor spinning shaft axis, said yarn withdrawal duct means including a mouth area on an end adjacent said deflecting means.

3. Apparatus as in claim 2, including a plurality of said spinning units and a movable servicing apparatus that can operate on individual spinning units and which includes at least a portion of said yarn returning means.

4. Apparatus as in claim 3, further including air current generating means disposed in the area of said yarn withdrawal duct means mouth area for generating an air current toward said yarn withdrawal duct means mouth area.

5. Apparatus as in claim 4, further including cover means covering said deflecting means and said yarn withdrawal duct means mouth, said air current generating means comprising a tube extending through said cover means and extending up adjacent to said yarn withdrawal duct means mouth area at least partially below said deflecting means.

6. Apparatus as in claim 5, wherein said air current generating means are connected with one of a vacuum and an excess-pressure supply element of said movable servicing apparatus in a piecing position.

7. Apparatus as in claim 4, wherein said air current generating means comprise a duct extending through said housing lid from said spinning rotor housing area to an area adjacent the yarn withdrawal duct means mouth below said deflecting means and comprise a flap means for covering said duct in a spinning position and for opening said duct in a piecing position.

8. Apparatus as in claim 7, wherein said duct is connected to one of a vacuum and an excess-pressure supply line of said spinning units.

9. Apparatus as in claim 3, wherein said movable servicing apparatus includes blowing air current means for generating a blowing air current directed toward said yarn withdrawal duct means mouth area.

10. Apparatus as in claim 9, further including guiding means disposed downstream from said deflecting means for guiding yarn and for guiding said blowing air current, said air current blowing means being applied to said guiding means in a piecing position.

11. Apparatus as in claim 3, wherein said movable servicing apparatus includes said yarn return guiding means for guiding the return of said yarn end to said yarn withdrawal duct means mouth area during a piecing operation; in a piecing position, said yarn return delivery guiding means being applied adjacent said yarn withdrawal duct means mouth area such that said returning yarn end bypasses said deflecting means.

12. Apparatus as in claim 11, wherein each said spinning unit further includes yarn return guiding means aligning elements for aligning said yarn return guiding means with respect to said yarn withdrawal duct means mouth area.

13. Apparatus as in claim 3, further including covering means for covering said deflecting means and said yarn withdrawal duct means mouth area, said covering means including a recess area through which said movable servicing apparatus portion of said yarn returning means are guided during a piecing operation.

14. Apparatus as in claim 3, wherein said deflecting means include a spinning position for deflecting yarn in which said deflecting means is disposed outside any closed ducts such that yarn impurities are prevented from accumulating in a spinning yarn path.

15. Apparatus as in claim 14, further including collecting means disposed below said deflecting means for collecting impurities detached from said yarn for removal from each said spinning unit.

16. Apparatus as in claim 15, further including means for removing said impurities from said collecting means and each said spinning unit.

17. Apparatus as in claim 3, wherein said yarn piecing path deviates from said yarn spinning path such that said returning yarn end avoids said deflecting means such that there is no deflection of the yarn at said deflecting means during said piecing process.

18. Apparatus as in claim 2, wherein said yarn withdrawal duct means mouth area is expanded in a funnel shape.

19. Apparatus as in claim 2, wherein said deflecting means is adjustable between a spinning position and a piecing position, in said piecing position at least said at least one false-twisting edge being disposed away from an axis extending out from said yarn withdrawal duct means axis.

20. Apparatus as in claim 2, further including guiding means disposed downstream from said deflecting means for guiding yarn.

21. Apparatus as in claim 20, further including covering means for covering said deflecting means and at least a portion of said guiding means.

22. Apparatus as in claim 21, wherein said guiding means are mounted at said covering means.

23. Apparatus as in claim 6, wherein said guiding means comprise an open channel.

24. Apparatus as in claim 20, wherein said guiding means comprise a tube.

25. Apparatus as in claim 20, wherein said guiding means are connected to said mouth area of said yarn withdrawal duct means in certain connecting predetermined positions.

26. Apparatus as in claim 25, wherein said guiding means and said yarn withdrawal duct means mouth area are separated by a gap in certain predetermined gap positions and are connected by sealing means in said connecting predetermined positions thereby forming a connecting duct between said guiding means and said yarn withdrawal duct means.

27. Apparatus as in claim 20, wherein said guiding means is adjustable relative to said yarn withdrawal duct means between a spinning position and a piecing position.

28. Apparatus as in claim 27, further including a plurality of said spinning units and a movable servicing apparatus that can operate on individual spinning units and which includes at least a portion of said yarn returning means, wherein said adjustment of the guiding means is activated by said movable servicing apparatus.

29. Apparatus as in claim 20, wherein said deflecting means is mounted on said guiding means.

30. Apparatus as in claim 30, wherein said deflecting means is adjustable between a spinning position and a piecing position, in said piecing position at least said at least one false-twisting edge being disposed away from an axis extending out from said yarn withdrawal duct means axis.

31. Apparatus as in claim 30, further including spring holding means for holding said deflecting means in said spinning position.

32. Apparatus as in claim 30, further including connecting means for connecting said guiding means to said yarn withdrawal duct means in a piecing position, wherein said deflecting means is disposed in a gap between said yarn withdrawal duct means mouth area and said guiding means in an area of said axis extending out from said yarn withdrawal duct means axis in said spinning position, said connecting means being coordinated with said deflecting means such that both are adjusted to said piecing positions during a piecing process.

33. Apparatus as in claim 32, wherein said connecting means form a substantially airtight connection between said guiding means and said yarn withdrawal duct means in said piecing position.

34. Apparatus as in claim 2, wherein said deflecting means is detachably attached to said rotor housing lid.

35. Apparatus as in claim 2, wherein said yarn travelling in said yarn piecing path is deflected less at said deflecting means than said yarn traveling in said yarn spinning path.

36. Apparatus as in claim 1, wherein said yarn travelling in said yarn piecing path is deflected less at said deflecting means than said yarn traveling in said yarn spinning path.

* * * * *